US007753056B2

(12) United States Patent
Borschke et al.

(10) Patent No.: US 7,753,056 B2
(45) Date of Patent: Jul. 13, 2010

(54) SMOKABLE ROD FOR A CIGARETTE

(75) Inventors: August Joseph Borschke, Winston-Salem, NC (US); Dwayne William Beeson, Kernersville, NC (US); Sharon Pitts Dunlap, Walnut Cove, NC (US); Thomas Albert Perfetti, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 12/391,514

(22) Filed: Feb. 24, 2009

(65) Prior Publication Data

US 2009/0151739 A1 Jun. 18, 2009

Related U.S. Application Data

(62) Division of application No. 10/675,577, filed on Sep. 30, 2003, now Pat. No. 7,503,330.

(51) Int. Cl.
*A24D 1/00* (2006.01)

(52) U.S. Cl. ..... 131/360; 131/365

(58) Field of Classification Search ..... 131/360, 131/365

See application file for complete search history.

(56) References Cited

U.S. PATENT DOCUMENTS 1,829,559 A 10/1931 Gilliam
3,258,015 A 6/1966 Ellis et al.
3,349,776 A 10/1967 Bell et al.

(Continued)

FOREIGN PATENT DOCUMENTS

EP 0 378 788 A1 7/1990

(Continued)

OTHER PUBLICATIONS

*Chemical and Biological Studies on New Cigarette Prototypes that Heat Instead of Burn Tobacco*, R. J. Reynolds Tobacco Company Monograph, 1988. pp. 24/72.

(Continued)

*Primary Examiner*—Eric Hug
*Assistant Examiner*—Dennis Cordray
(74) *Attorney, Agent, or Firm*—Brinks Hofer Gilson & Lione

(57) ABSTRACT

A smokable rod for a smoking article, such as a cigarette, possesses a co-axial or concentric construction. The outer material that circumscribes the inner core in an annular fashion is composed of a tobacco material treated with a burn suppressing agent, and the outer material acts as a substrate for an aerosol forming material. A preferred aerosol forming material is glycerin. An outer paper wrapper circumscribes the length of the smokable rod, and another paper wrapping material also can circumscribe the inner core material. In use, one end of the smokable rod is lit, and the tobacco cut filler of the inner core burns to yield tobacco smoke. The outer material smolders, and hence thermal decomposition products of the outer tobacco material and volatilized aerosol forming material are produced. Alternatively, a smokable rod can be provided by positioning the tobacco cut filler in the outer annular region, and by constructing the inner core portion using the tobacco material treated with aerosol forming material and a burn suppressing agent.

23 Claims, 2 Drawing Sheets

U.S. PATENT DOCUMENTS 3,356,094 A 12/1967 Ellis et al.
3,461,879 A 8/1969 Kirkland
3,516,417 A 6/1970 Moses
3,614,956 A 10/1971 Thornton
3,736,941 A 6/1973 Molins et al.
3,738,374 A 6/1973 Bennett
3,844,294 A 10/1974 Webster
3,878,850 A 4/1975 Gibson et al.
3,910,287 A 10/1975 Walton
3,931,824 A 1/1976 Miano et al.
3,943,941 A 3/1976 Boyd et al.
3,957,062 A 5/1976 Labbe et al.
3,987,804 A 10/1976 Molins et al.
4,044,777 A 8/1977 Boyd et al.
4,079,742 A 3/1978 Rainer et al.
4,207,906 A 6/1980 Seehofer et al.
4,219,031 A 8/1980 Rainer et al.
4,233,993 A 11/1980 Miano et al.
4,286,604 A 9/1981 Ehretsmann et al.
4,326,544 A 4/1982 Hardwick et al.
4,340,072 A 7/1982 Bolt et al.
4,347,855 A 9/1982 Lanzillotti et al.
4,391,285 A 7/1983 Burnett et al.
4,489,739 A 12/1984 Mattina et al.
4,506,684 A 3/1985 Keritsis
4,580,579 A 4/1986 Wahle et al.
4,593,704 A 6/1986 Wahle et al.
4,632,130 A 12/1986 Heitmann et al.
4,714,082 A 12/1987 Banerjee et al.
4,716,913 A 1/1988 Brackmann
4,727,888 A 3/1988 Luke
4,736,754 A 4/1988 Heitmann et al.
4,771,795 A 9/1988 White et al.
4,793,365 A 12/1988 Sensabaugh, Jr. et al.
4,819,665 A 4/1989 Roberts et al.
4,836,224 A 6/1989 Lawson et al.
4,874,004 A 10/1989 Borowski et al.
4,878,507 A 11/1989 Case et al.
4,892,109 A 1/1990 Strubel
4,911,184 A 3/1990 Case et al.
4,917,121 A 4/1990 Riehl et al.
4,917,128 A 4/1990 Clearman et al.
4,924,883 A 5/1990 Perfetti et al.
4,924,886 A 5/1990 Litzinger
4,924,888 A 5/1990 Perfetti et al.
4,947,874 A 8/1990 Brooks et al.
4,961,438 A 10/1990 Korte
4,962,773 A 10/1990 White et al.
4,966,171 A 10/1990 Serrano et al.
4,981,522 A 1/1991 Nichols et al.
4,986,287 A 1/1991 Schneider et al.
4,991,596 A 2/1991 Lawrence et al.
5,025,812 A 6/1991 Fagg et al.
5,033,483 A 7/1991 Clearman et al.
5,046,514 A 9/1991 Bolt
5,058,608 A 10/1991 Henning et al.
5,060,667 A 10/1991 Strubel
5,060,676 A 10/1991 Hearn et al.
5,065,775 A 11/1991 Fagg
5,065,776 A 11/1991 Lawson et al.
5,074,321 A 12/1991 Gentry et al.
5,085,232 A 2/1992 Raker et al.
5,090,426 A 2/1992 Tang et al.
5,099,861 A 3/1992 Clearman et al.
5,101,839 A 4/1992 Jakob et al.
5,105,835 A 4/1992 Drewett et al.
5,105,836 A 4/1992 Gentry et al.
5,105,838 A 4/1992 White et al.
5,129,408 A 7/1992 Jakob et al.
5,131,414 A 7/1992 Fagg et al.
5,137,034 A 8/1992 Perfetti et al.
5,159,940 A 11/1992 Hayward et al.
5,159,942 A 11/1992 Brinkley et al.
5,178,167 A 1/1993 Riggs et al.
5,183,062 A 2/1993 Clearman et al.
5,211,684 A 5/1993 Shannon et al.
5,234,008 A 8/1993 Fagg
5,249,588 A 10/1993 Brown et al.
5,265,626 A * 11/1993 Schneider et al. ..... 131/341
5,271,419 A 12/1993 Arzonico et al.
5,285,798 A 2/1994 Banerjee et al.
5,327,917 A 7/1994 Lekwauwa et al.
5,345,951 A 9/1994 Serrano et al.
5,360,022 A 11/1994 Newton et al.
5,379,789 A 1/1995 Schneider et al.
5,396,911 A 3/1995 Casey, III et al.
5,415,186 A 5/1995 Casey, III
5,439,011 A * 8/1995 Schneider ..... 131/360
5,598,868 A 2/1997 Jakob et al.
5,715,844 A 2/1998 Young et al.
5,730,160 A 3/1998 Schneider et al.
5,778,899 A 7/1998 Saito et al.
5,819,751 A 10/1998 Barnes et al.
5,983,901 A 11/1999 Luke et al.
6,095,153 A 8/2000 Kessler et al.
6,182,670 B1 2/2001 White et al.
6,202,648 B1 3/2001 Schumacher et al.
6,257,243 B1 7/2001 Müller et al.
6,367,481 B1 4/2002 Nichols et al.
6,397,852 B1 6/2002 McAdam
6,408,856 B1 6/2002 McAdam
6,578,584 B1 6/2003 Beven et al.
7,503,330 B2 * 3/2009 Borschke et al. ..... 131/360
2004/0025894 A1 2/2004 Beven et al.
2005/0066985 A1 3/2005 Borschke et al.
2005/0066986 A1 3/2005 Nestor et al.

FOREIGN PATENT DOCUMENTS

EP 0 419 974 A2 4/1991
EP 0 545 186 A2 6/1993
EP 1 670 326 B1 2/2007
GB 1 431 045 A2 4/1976
GB 2 070 409 A 9/1981
WO WO 98/16125 4/1998
WO WO 98/57556 12/1998
WO WO 03/020059 A1 3/2003
WO WO 03/092416 A1 11/2003

OTHER PUBLICATIONS

Gardner, et al. (Eds.), Inhalation *Toxicology*, 2000, vol. 12, No. 5, pp. 1/9.

Liu, et al., "Potassium organic salts as burn additives in cigarettes"; *Beiträge zur Tabakforschung/International Contributions to Tobacco Research*, 2003, vol. 20, No. 5, pp. 341/47.

Mattina, "Altering the combustion of tobacco through the addition of alkali metal carboxylate salts"; *39th Tobacco Chemists'* Research *Conference in Montreal, Quebec, Canada*, Oct. 3, 1985.

Transaction History dated Mar. 19, 2009, from Patent Application Information Retrieval for co-pending U.S. Appl. No. 10/674,909, including each substantive office action and applicant response.

* cited by examiner

SMOKABLE ROD FOR A CIGARETTE

This application is a divisional of U.S. patent application Ser. No. 10/675,577, filed Sep. 30, 2003, now U.S. Pat. No. 7,503,330, the disclosure of which is incorporated herein by reference.

FIELD OF THE INVENTION

The present invention relates to tobacco products, such as smoking articles (e.g., cigarettes).

BACKGROUND

Popular smoking articles, such as cigarettes, have a substantially cylindrical rod shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. See, for example, UK Pat. Spec. 755,475. Certain cigarettes incorporate a filter element having multiple segments, and one of those segments can comprise activated charcoal particles. See, for example, U.S. Pat. Nos. 5,360,023 to Blakley et al. and 6,537,186 to Veluz. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in *Tobacco Production, Chemistry and Technology*, Davis et al. (Eds.) (1999). Certain types of cigarettes have possessed tobacco rods of relatively small circumference, such as those marketed commercially as "Capri" by Brown and Williamson Tobacco Corporation and "Virginia Slims Superslims" by Philip Morris Inc. See, for example, the types of cigarettes described in U.S. Pat. Nos. 4,637,410 to Luke; 4,878,507 to Case et al. and 4,911,184 to Case et al. A cigarette is employed by a smoker by lighting one end thereof and burning the tobacco rod. The smoker then receives mainstream smoke into his/her mouth by drawing on the opposite end (e.g., the filter end) of the cigarette.

There have been proposed numerous types of cigarettes, each of which has a rod composed of tobacco material configured such that a longitudinally extending central portion of that rod is formed as an air channel or is composed of a lesser amount of tobacco material than is used to provide the outer portion of that rod. U.S. Pat. No. 3,096,772 to Korber proposes a cigarette rod possessing tobacco filler formed so as to have a centrally located longitudinally extending air channel. U.S. Pat. No. 3,349,776 to Bell et al. proposes a cigarette having an outer region of tobacco surrounding a longitudinally extending column of a lower density. British Pat. No. 1,086,443 proposes a cigarette having a centrally extending cylindrical passage or a core whose density is less than the density of the surrounding outer layer. UK Pat. Spec. 1,054,557 and U.S. Pat. Nos. 4,632,130 to Heitmann et al. and 4,736,754 to Heitmann et al. each propose the manufacture of a cigarette rod having a central portion of smokable material of lesser density and an outer layer of smokable material of greater density.

There have been proposed numerous types of cigarettes, each of which has an axial inner zone of smokable material of a constitution different from that of a smokable material that is disposed outside of that zone. U.S. Pat. No. 1,829,559 to Gilliam proposes a cigarette having a paper wrapper and filler composed of different species of tobacco, and each species is disposed in a separate stratum or layer throughout the entire length of the cigarette. U.S. Pat. Nos. 3,736,941 to Molins et al.; 3,957,062; 3,987,804 to Molins et al.; and 4,207,906 to Seehofer et al.; and UK Pat. Spec. 1,416,020 propose manufacturing a cigarette rod having a core of filler material different from an annulus of shredded tobacco. U.S. Pat. Nos. 4,580,579 to Wahle et al. and 4,593,704 to Wahle et al. each propose equipment and methods for producing a rod of tobacco filler having a core containing a first particulate material surrounded by an annular envelope containing a different second particulate material. U.S. Pat. No. 4,716,913 to Brackmann proposes a cigarette having a core of lesser quality tobacco smoking material surrounded by an annulus of higher quality smoking material.

There have been proposed numerous types of cigarettes, each of which has an inner zone of smokable material contained within a wrapper and an outer zone of smokable material that is disposed outside of that zone. U.S. Pat. No. 3,910,287 to Walton proposes a cigarette-type smoking device having inner and outer wrappers of cigarette paper or reconstituted tobacco, with the space within the inner wrapper defining the major volume of the device and the principal tobacco-filled combustion zone, while the space between the wrappers defines a minor volume and a secondary tobacco-filled combustion zone. A so-called "coaxial cigarette" possesses an inner core of tobacco material, a sheath for the inner core, an outer jacket of material coaxially surrounding the inner core and sheath, and a sheath for the outer jacket. See, for example, U.S. Pat. No. 4,986,287 to Schneider et al. U.S. Pat. No. 4,874,004 to Borowski et al. proposes a coaxial cigarette having an inner core of a smokable material, a first wrapper for the inner core, an outer jacket of another smokable material surrounding the inner core, and a second wrapper for the outer jacket. U.S. Pat. No. 6,257,243 to Muller et al. proposes a coaxial cigarette possessing an inner segment of smokable material, a covering for the inner segment, an outer segment of tobacco material surrounding the inner segment, and a covering for the outer segment. PCT WO 98/57556 to Biggs et al. proposes a coaxial cigarette possessing an inner segment of tobacco material, a wrapper for the inner segment, an outer segment of smokable material surrounding the inner segment, and a covering for the outer segment. U.S. Pat. No. 4,727,888 to Luke proposes manufacturing a cigarette rod by surrounding a rod of filler material wrapped in a wrapper material with a smoking material, and wrapping a wrapper material about the smoking material. U.S. Pat. Nos. 3,987,804 to Molins et al. and 6,202,648 to Schumacher et al. each propose equipment and methods for manufacturing a cigarette rod having a tubular insert that is surrounded by a smokable material.

Other types of coaxial or concentric-type smoking articles have been proposed. Certain proposed cigarette-type smoking articles have possessed tobacco smokable materials surrounding longitudinally extending cores of other materials. UK Pat. Application 2,070,409 proposes smoking article having a rod of smoking material having at least one filament extending over a least a major portion of the length of the rod. U.S. Pat. No. 3,614,956 to Thornton proposes a smoking article having an annular outer portion made of tobacco smoking material and a central cylindrical core of absorbent material. U.S. Pat. No. 4,219,031 to Rainer et al. proposes a smoking article having a central core of carbonized fibers circumscribed by tobacco. U.S. Pat. No. 6,367,481 to Nichols et al. proposes a cigarette possessing an ignition element surrounded by tobacco, which is in turn surrounded by a composite outer wrapper. One type of cigarette-type smoking article has possessed a rod of tobacco smokable material surrounded a longitudinally extending annulus of some other material. U.S. Pat. No. 5,105,838 to White et al. proposes a rod of smokable material, normally circumscribed by a layer of wrapping materials, which is in turn circumscribed by an insulating material (e.g., glass fibers). PCT WO 98/16125 to Snaidr et al. proposes a smoking device constructed from a very thin cigarette designed to fit into a tubular ceramic cartridge.

Through the years, there have been proposed various methods for altering the composition of mainstream tobacco smoke. In PCT WO 02/37990 to Bereman, it has been suggested that metallic particles and/or carbonaceous particles can be incorporated into the smokable material of a cigarette in an attempt to reduce the amounts of certain compounds in the smoke produced by that cigarette. In addition, numerous tobacco substitute materials have been proposed, and substantial listings of various types of those materials can be found in U.S. Pat. Nos. 4,079,742 to Rainer et al. and 4,771,795 to White et al. Certain cigarette-type products that employ non-tobacco materials (e.g., dried vegetable leaves, such lettuce leaves) as filler that is burned to produce smoke that resembles tobacco smoke have been marketed under the tradenames "Cubebs," "Triumph," "Jazz," and "Bravo." See, for example, the types of materials described in U.S. Pat. No. 4,700,727 to Torigian. Furthermore, tobacco substitute materials having the tradenames "Cytrel" and "NSM" were introduced in Europe during the 1970s. Representative types of proposed synthetic tobacco substitute materials, and cigarettes incorporating those materials, are described in British Pat. No. 1,431,045; and U.S. Pat. Nos. 3,738,374 to Bennett; 3,844,294 to Webster; 3,878,850 to Gibson et al.; 3,931,824 to Miano et al.; 3,943,941 to Boyd et al.; 4,044,777 to Boyd et al.; 4,233,993 to Miano et al.; 4,286,604 to Ehretsmann et al.; 4,326,544 to Hardwick et al.; 5,046,514 to Bolt; 5,074,321 to Gentry et al.; 5,092,352 to Montoya et al.; 5,778,899 to Saito et al.; 6,397,852 to McAdam; and 6,408,856 to McAdam. Various types of highly processed smokable materials incorporating tobacco and other ingredients are set forth in U.S. Pat. Nos. 4,874,000 to Tamol et al.; 5,072,744 to Luke et al.; 5,829,453 to White et al. and 6,182,670 to White et al.

Numerous references have proposed various smoking articles of a type that generate flavored vapor, visible aerosol, or a mixture of flavored vapor and visible aerosol. Some of those proposed types of smoking articles possess tubular sections or longitudinally extending air passageways. See, for example, those types of smoking articles described in U.S. Pat. Nos. 3,258,015 to Ellis et al.; 3,356,094 to Ellis et al.; 3,516,417 to Moses; 4,347,855 to Lanzellotti et al.; 4,340,072 to Bolt et al.; 4,391,285 to Burnett et al.; 4,917,121 to Riehl et al.; 4,924,886 to Litzinger; and 5,060,676 to Hearn et al. Many of those types of smoking articles have employed a combustible fuel source that is burned to provide an aerosol and/or to heat an aerosol forming material. See, for example, the background art cited in U.S. Pat. Nos. 4,714,082 to Banerjee et al. and 4,771,795 to White et al.; which are incorporated herein by reference in their entireties. See, also, for example, those types of smoking articles described in U.S. Pat. Nos. 4,714,082 to Banerjee et al.; 4,771,795 to White et al.; 4,793,365 to Sensabaugh; 4,917,128 to Clearman et al.; 4,961,438 to Korte; 4,966,171 to Serrano et al.; 5,033,483 to Clearman et al.; 5,065,776 to Lawson; 5,099,861 to Clearman et al.; 5,105,835 to Drewett et al.; 5,159,940 to Hayward et al.; 5,178,167 to Riggs et al.; 5,183,062 to Clearman et al.; 5,211,684 to Shannon et al.; 5,551,451 to Riggs et al.; 5,595,577 to Bensalem et al.; 5,819,751 to Barnes et al.; 6,095,153 to Beven et al; 6,578,584 Beven; and PCT WO 97/48294. Furthermore, certain types of cigarettes have been commercially marketed under the brand names "Premier" and "Eclipse" by R. J. Reynolds Tobacco Company. See, for example, those types of cigarettes described in *Chemical and Biological Studies on New Cigarette Prototypes that Heat Instead of Burn Tobacco*, R. J. Reynolds Tobacco Company Monograph (1988) and *Inhalation Toxicology,* 12:5, p. 1-58 (2000).

Yet other types of smoking articles, such as those types of smoking articles that generate flavored vapors by subjecting tobacco or processed tobaccos to heat produced from chemical or electrical heat sources are described in U.S. Pat. Nos. 4,947,874 to Brooks et al.; 5,224,498 to Deevi; 5,285,798 to Banerjee et al.; 5,357,984 to Farrier et al.; 5,593,792 to Farrier et al.; 5,369,723 to Counts; and 6,164,287 to White. One type of smoking article that has employed electrical energy to produce heat has been commercially marketed by Philip Morris Inc. under the brand name "Accord."

Smoking articles that employ tobacco substitute materials, and smoking articles that employ sources of heat other than tobacco cut filler to produce tobacco-flavored vapors or tobacco-flavored visible aerosols, have not received widespread commercial success. It would be highly desirable to provide a smoking article, such as a cigarette, that possesses the ability to provide to a smoker the benefits and advantages of conventional cigarette smoking without delivering considerable quantities of incomplete combustion and pyrolysis products.

BRIEF SUMMARY

In one aspect, the present invention relates to a smokable rod, and a smoking article (e.g., a cigarette) incorporating such as rod. That smokable rod possesses an outer wrapping material; and a smokable material (e.g., a tobacco material in cut filler form) is disposed within that outer wrapping material. Aerosol forming material is incorporated within the smokable rod; and typically, at least a portion of the smokable material within the smokable rod acts as a substrate for an aerosol forming material. For example, the aerosol forming material in intimate contact with a processed tobacco material that is processed such that (i) at least a portion of a solvent soluble portion (e.g., a water soluble extract portion) of the tobacco material is removed therefrom, and (ii) that processed tobacco material is a substrate for the aerosol forming material. At least a portion of the smokable material within the smokable rod can be treated with an agent capable of having an effect upon the thermal decomposition properties of the smokable material with which that agent is in intimate contact; and such an agent is referred to as a "burn suppressing agent." At least a portion of the smokable material can both act as a substrate for the aerosol forming material and be in intimate contact with the burn suppressing agent.

In use, the lighting end of a cigarette incorporating the smokable rod is lit, and the smokable material undergoes thermal decomposition, and hence yields smoke. At least some of the smokable material (i.e., that which has been treated so as to avoid the tendency to burn) undergoes char or smolder, for a cigarette incorporating smokable material has been treated with the burn suppressing agent. Such charring or smoldering is characteristic of smokable material that does not undergo the type of burning that would be considered complete when a traditional type of tobacco cut filler is consumed during use of the smokable rod of a traditional type of tobacco burning cigarette. Some portion or all of the smokable material (e.g., that portion that is not treated with burn suppressing agent) can undergo burning, and hence yield smoke that can be considered to be somewhat characteristic of a traditional type of cigarette that is intended to burn tobacco cut filler. In addition, the aerosol forming material that is located within the smokable rod (e.g., that is carried by at least some portion of the smokable material of the smokable rod) is volatilized by the action of heat so produced when the smokable rod is smoked. As such, when the mouth end of the cigarette is drawn upon by the smoker, the smoker can inhale smoke from some of the burning smokable material, as well as volatilized aerosol forming material, and other components resulting from the action of heat upon the smokable material.

In another aspect, the present invention relates to a smokable rod, and a smoking article (e.g., a cigarette) incorporating such a rod. That smokable rod possesses an outer wrapping material; a first material (e.g., a smokable material, such as tobacco material in cut filler form) is disposed within the outer wrapping material; a second material (e.g., a smokable material, such as tobacco material in cut filler form) is disposed within the first material, and extends longitudinally through the first material; and preferably an inner wrapping material is disposed between first and second materials. That is, the rod possesses (i) a portion or region of a smokable material that is configured in a rod-like shape that extends longitudinally through the central region of that rod, thereby providing an inner core region of smokable material; (ii) an outer portion or region of material positioned around the inner core, thereby forming an annulus or sheath that circumscribes or coaxially surrounds the inner core of smokable material; (iii) a wrapping material that longitudinally circumscribes the outer portion of outer material; and preferably (iv) a wrapping material that longitudinally circumscribes the inner core region of smokable material and is positioned so as to physically separate the outer and inner portions of the respective first and second materials from one another.

In use, the lighting end of a cigarette incorporating the smokable rod is lit, and the inner core material (e.g., tobacco cut filler) burns to yield smoke. The outer material of the smokable rod (e.g., tobacco cut filler), which can be treated so as to avoid the tendency to burn, undergoes some type of thermal decomposition, and hence, generates heat as well as thermal decomposition products of tobacco. For example, at least a portion of the outer material can be in intimate contact with a burn suppressing agent. At least a portion of the inner core material and/or at least a portion of the outer sheath material can be configured so as to be in intimate contact with an aerosol forming material (e.g., components of either or both of those first and second materials can act as substrates for the aerosol forming material). As such, when the mouth end of the cigarette is drawn upon by the smoker, the smoker can inhale smoke that results from burning the material of the inner core, as well as volatilized aerosol forming material, and other components resulting from the burning or other action of heat upon the material of the outer sheath.

In another aspect, the present invention relates to a smokable rod, and a smoking article (e.g., a cigarette) incorporating such a rod. That smokable rod possesses an outer wrapping material; a first material (e.g., a smokable material, such as tobacco material in cut filler form) is disposed within the outer wrapping material; a second material (e.g., a smokable material, such as tobacco material in cut filler form) is disposed within the first material, and extends longitudinally through the first material; and preferably an inner wrapping material is disposed between first and second materials.

In use, the lighting end of a cigarette incorporating the smokable rod is lit, and the outer material (e.g., tobacco cut filler) burns to yield smoke. At least a portion of the inner core material and/or at least a portion of the outer sheath material can be configured so as to be in intimate contact with an aerosol forming material (e.g., components of either or both of those first and second materials can act as substrates for the aerosol forming material). The inner material of the smokable rod (e.g., tobacco cut filler), which can be treated so as to avoid the tendency to burn, undergoes some type of thermal decomposition, and hence, generates heat. For example, at least a portion of the inner material can be in intimate contact with a burn suppressing agent. As such, when the mouth end of the cigarette is drawn upon by the smoker, the smoker can inhale smoke from burning the material of the outer sheath, as well as volatilized aerosol forming material, and other components resulting from the burning or other action of heat upon the material of the inner core.

In yet another aspect, the present invention relates to a smoking article (e.g., a cigarette) incorporating a smokable rod of any of the types described previously. That cigarette possesses a smokable rod, a mouth end piece, and a segment of smokable material (e.g., tobacco material in cut filler form) located between the smokable rod and the mouth end piece.

In use, the lighting end of the smokable rod of the cigarette is lit, and the smokable material of that rod burns to yield smoke. The portion of the smokable material of the smokable rod that has been treated so as to avoid the tendency to burn undergoes some type of thermal decomposition. Aerosol forming material, which is in intimate contact with at least some of the smokable material within the smokable rod, is subjected to the heat produced by action of heat generated by the burning or other associated thermal decomposition of those materials. As such, when the mouth end of the cigarette is drawn upon by the smoker, the smoker can inhale smoke from burning tobacco, as well as volatilized aerosol forming material, and other components resulting from the burning or other action of heat upon those materials. The drawn aerosol passes through the segment of smokable material before passing through the mouth end piece.

A preferred cigarette of the present invention, when smoked, provides a flavorful and satisfying mainstream aerosol. Highly preferred cigarettes provide the flavors, sensations and satisfaction of popular cigarettes that burn tobacco cut filler, because those preferred cigarettes generate mainstream aerosol, at least in part, by burning, charring or otherwise causing thermal degradation of tobacco cut filler. Those preferred cigarettes smolder at acceptable rates, provide an acceptable number of puffs, and are capable of maintaining acceptable static smolder, at least when smoked under FTC smoking conditions. A preferred cigarette, when smoked, yields a firecone and ash that are acceptable. A preferred ash is not easily dislodged for the cigarette, and is not overly flakey. A preferred firecone has an acceptable shape and size, is not overly cohesive (i.e., desired portions of the ash can be flicked, or otherwise easily removed, from the cigarette in much the same manner that the ash is removed from a cigarette that burns down), and is not overly fragile (i.e., the firecone and ash maintain their integrity to an acceptable degree). Generally, the ash of a cigarette possessing smokable material treated with burn suppressing agent has a tendency to exhibit a darker color than that of traditional cigarettes that burn tobacco cut filler, because of the smokable material that has been treated with burn suppressing agent preferably has a tendency to smolder or char, rather than burn more completely.

DETAILED DESCRIPTION OF THE PREFERRED EMBODIMENTS

Aspects and embodiments of the present invention relating to various smoking articles are illustrated with reference to FIGS. 1 through 4. Like components are given like numeric designations throughout the figures.

Figure 1:
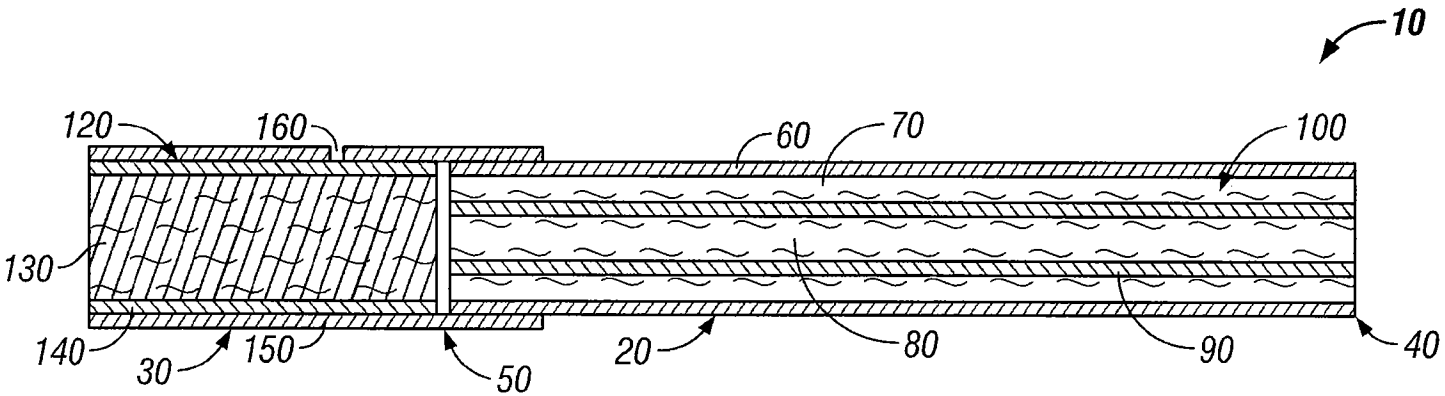
FIGS. 1 through 4 are longitudinal cross-sectional views of smokable rods and smoking articles representative of the present invention.

Referring to FIG. 1, a representative preferred smoking article 10 in the form of a cigarette is shown. The smoking article 10 has rod-like shape. The cigarette 10 includes a generally cylindrical smokable rod 20; and a generally cylindrical mouth end piece 30 positioned at one end of that smokable rod. As such, the cigarette 10 possesses a lighting end 40 and a mouth end 50.

The smokable rod 20 possesses an outer wrapping material 60. A first material 70 is disposed within, and circumscribed by, the outer wrapping material 60. As such, the longitudinally extending outer surface of the smokable rod 20 is provided by the outer wrapping material 60. A representative first material 70 is a smokable material (e.g., tobacco material in cut filler form). An aerosol forming material (not shown) can be located in the region occupied by the first material 70, and as such, the first material can act as a substrate for that aerosol forming material. The first material 70 also can be treated in such a manner that the material does not exhibit a tendency to burn, but rather, that material exhibits a propensity to smolder or char. A second material 80 is disposed within the first material 70. A representative second material 80 is a smokable material (e.g., tobacco material in cut filler form). A charge or roll of the second material 80 is contained in an optional circumscribing inner wrapping material 90. Both ends of the smokable rod 20 are open to expose the first and second materials 70, 80. That is, it is preferable that both the inner core of smokable material 80 and the outer material 80 be configured so that both of those materials extend along the entire length of the smokable rod.

The second material 80 and preferred circumscribing inner wrapping material 90 are assembled and configured so as to form a rod-like shape, thereby forming an inner rod 100. The inner rod 100 extends longitudinally through the central region of the cigarette 10, thereby providing an inner core region of smokable material 80. Preferably, the inner rod 100 is centrally located with the smokable rod 20; however, it is not strictly necessary that the radial depth of the outer material 70 be identical over all regions of the smokable rod. The outer portion or region of the first material 70 is positioned around the inner rod 100, thereby forming an annulus or sheath that circumscribes or coaxially surrounds that inner rod. The inner wrapping material 90 that longitudinally circumscribes the second material 80 is positioned so as to physically separate the first and second materials 70, 80 from one another. That is, the first and second materials 70, 80 are radially disposed from one another.

The cigarette 10 normally includes a filter element 120, or other suitable mouthpiece, positioned at the mouth end 50 thereof. The filter element 120 is positioned adjacent one end of the smokable rod 20, such that the filter element and smokable rod are axially aligned in an end-to-end relationship, preferably abutting one another. The general cross-sectional shapes and dimensions of the smokable rod 20 and filter element 120, when viewed transversely to the longitudinal axis of the cigarette, are essentially identical to one another. Both ends of the filter element 120 are open to permit the passage of aerosol therethrough. The filter element 120 includes filter material 130 (e.g., plasticized cellulose acetate tow) that is overwrapped along the longitudinally extending surface thereof with circumscribing plug wrap material 140. A typical plug wrap material 140 is a paper material, such as a paper that his highly porous to air flow.

The filter element 120 most preferably is attached to the mouth end 50 of the smokable rod 20 using tipping material 150, which circumscribes both the entire length of the filter element and an adjacent region of the smokable rod. The inner surface of the tipping material 150 is fixedly secured to the outer surface of the plug wrap material 140 and the outer surface of the outer wrapping material 60 of the smokable rod 20, using a suitable adhesive. A ventilated or air diluted cigarette is provided with an air dilution means, such as a series of perforations 160, each of which extend through the tipping material 150 and plug wrap material 140.

During use, the smoker lights the lighting end 40 of the cigarette 10 using a match or cigarette lighter, in a manner similar to the way that conventional cigarettes are lit. As such, the smokable material 80 of the inner rod 100 at the lighting end of the cigarette begins to burn. The mouth end 50 of the cigarette 10 is placed in the lips of the smoker. Smoke generated by the burning smokable material 80 is drawn through the cigarette 10 from the smokable rod 20, through the filter element 120, and into the mouth of the smoker. Heat generated during lighting, and heat generated by the burning smokable material 80 is transferred to the region of the cigarette that surrounds the outer periphery of the inner rod 100. As such, the first material 70 is subjected to conditions sufficient for it to undergo some degree of thermal decomposition (e.g., the first material can burn and/or, depending upon the degree of treatment with burn suppressing agent, can undergo smolder or char). As a result, components derived from that first material 70 (e.g., volatile flavorful components of that first material) are entrained in the air that is drawn through that region of the smokable rod 20 of the cigarette 10. Also as a result, aerosol forming material (not shown), located in that region occupied by the first material 70, is volatilized and entrained in the air that is drawn through that region of the smokable rod 20 of the cigarette 10. The aerosol so formed also is drawn through the filter element 120 and into the mouth of the smoker, along with the aerosol (i.e., smoke) formed as a result of the burning of the smokable material 80. Due to the essentially random nature of the positioning of the cut filler in each longitudinally extending portion of the smokable rod, the aerosol generated within the rod passes through a rather tortuous, random path defined by the air spaces between pieces of cut filler, as opposed to a hollow passageway of the type that is formed within a formed (e.g., extruded or molded) processed smokable material. For a highly preferred cigarette, the inner core of smokable material 80, inner wrapping material 90 and outer wrapping material 60 gradually burn down, essentially as is the case for a traditional tobacco burning cigarette; while the outer material 70 that has been treated with burn suppressing agent, undergoes smolder, charring, or similar change in character, rather than a more complete burning. For a highly preferred cigarette, the thermal decomposition of the various materials of the smokable rod occur at comparable linear rates along the length of that rod, and as such, a coal or burning tip region produced during consumption of the smokable rod resembles in many regards the type of coal or burning tip of a traditional tobacco burning cigarette. Ash and charred materials that result as the hot coal passes from the lighting end to the mouth end can be flicked, or otherwise removed, from the cigarette, essentially in the manner that ash generated from burned tobacco cut filler is removed from a traditional type of tobacco burning cigarette.

Various embodiments of the smoking article 10 described with reference to in FIG. 1 can be provided by modifying the general composition of the inner material 80 that makes up the inner core 100 of the smokable rod 20. In one representative embodiment, at least a portion of the inner core material 80 can be combined with aerosol forming material. For example, some amount or all of the inner core material can be in intimate contact with aerosol forming material. In another representative embodiment, at least a portion of the inner core material 80 can be combined with aerosol forming material and burn suppressing agent. For example, some amount of the inner core material can be combined with aerosol forming material and some other amount of the inner core material can be combined with burn suppressing agent, some amount of the inner core material can be combined with both aerosol forming material and burn suppressing agent, or all of the inner core material can be combined with aerosol forming material and burn suppressing agent. For an embodiment incorporating burn suppressing agent within both the inner material 80 and outer material 70, it is preferable that the outer material incorporate an amount and type of burn suppressing agent sufficient to provide a higher degree of burn suppression.

Referring again to FIG. 1, another embodiment of the type of smokable rod 20 and smoking article 10 in the form of a cigarette is shown. That embodiment is representative of a less preferred aspect of the present invention. That cigarette 10 also includes a generally cylindrical smokable rod 20; and a generally cylindrical mouth end piece 30 positioned at one end of the smokable rod. The cigarette 10 also possesses a lighting end 40 and a mouth end 50.

The smokable rod 20 possesses an outer wrapping material 60. A first material 70 is disposed within, and circumscribed by, the outer wrapping material 60. As such, the longitudinally extending outer surface of the smokable rod 20 is provided by the outer wrapping material 60. A representative first material 70 is a smokable material (e.g., tobacco material in cut filler form). A second material 80 is disposed within the first material 70. A representative second material 80 is a smokable material (e.g., a processed tobacco material in cut filler form). An aerosol forming material (not shown) can be located in the region occupied by the second material 80, and as such, the second material can act as a substrate for that aerosol forming material. The second material 80 can be treated in such a manner that the material does not exhibit a tendency to burn, but rather, that material exhibits a propensity to smolder or char. A charge or roll of the second material 80 is contained in an optional circumscribing inner wrapping material 90. Both ends of the smokable rod 20 are open to expose the first and second materials 70, 80. That is, it is preferable that both the inner core of smokable material 80 and the outer material 80 be configured so that both of those materials extend along the entire length of the smokable rod. The second material 80 and preferred circumscribing inner wrapping material 90 are assembled and configured so as to form a rod-like shape, thereby forming an inner rod 100. The inner rod 100 extends longitudinally through the central region of the cigarette 10, thereby providing an inner core region of smokable material 80, in the general manner that is described previously.

The cigarette 10 normally includes a filter element 120, or other suitable mouthpiece, positioned at the mouth end 50 thereof. General details concerning the construction and positioning of the filter element 120 are set forth previously. The filter element 120 includes filter material 130 overwrapped along the longitudinally extending surface thereof with circumscribing plug wrap material 140. The filter element 120 is attached to the smokable rod 20 by tipping material 150; and the cigarette 10 can be air diluted by providing a series of perforations 160, each of which extend through the tipping material 150 and plug wrap material 140.

During use, the smoker lights the lighting end 40 of the cigarette 10 using a match or cigarette lighter, in a manner similar to the way that conventional cigarettes are lit. As such, the smokable material 70 that circumscribes the inner rod 100 is burned. The mouth end 50 of the cigarette 10 is placed in the lips of the smoker. Smoke generated by the burning smokable material 70 is drawn through the cigarette 10 from the smokable rod 20, through the filter element 120, and into the mouth of the smoker. Heat also is generated by burning or other type of thermal decomposition of the material that makes up the inner rod 100. As a result, smoke or other types of components derived from that second material 80 (e.g., volatile flavorful components of that second material) are entrained in the air that is drawn through that region of the smokable rod 20 of the cigarette 10. Also as a result, aerosol forming material (not shown), located in that region occupied by the second material 80, is volatilized and entrained in the air that is drawn through that region of the smokable rod 20 of the cigarette 10. The aerosol so formed also is drawn through the filter element 120 and into the mouth of the smoker, along with the aerosol (i.e., smoke) formed as a result of the burning of the smokable material 70. Due to the essentially random nature of the positioning of the cut filler in each longitudinally extending portion of the smokable rod, the aerosol generated within the rod passes through a rather tortuous, random path defined by the air spaces between pieces of cut filler, as opposed to a hollow passageway of the type that is formed within a formed (e.g., extruded or molded) processed smokable material. For a preferred cigarette, the outer smokable material 70, inner wrapping material 90 and outer wrapping material 60 burn down, essentially as is the case for a traditional tobacco burning cigarette; and the inner core material 80 that has been treated with burn suppressing agent, undergoes smolder, charring, or similar change in character, rather than burning. For a highly preferred cigarette, the thermal decomposition of the various materials of the smokable rod occur at comparable linear rates along the length of that rod, and as such, a coal or burning tip produced during consumption of the smokable rod may resemble in some regards the type of coal or burning tip region of a traditional tobacco burning cigarette. Ash and charred materials that result as the hot coal passes from the lighting end to the mouth end can be flicked, or otherwise removed from the cigarette, essentially in the manner that ash generated from burned tobacco cut filler is removed from a traditional type of tobacco burning cigarette.

Further embodiments of the smoking article 10 shown in FIG. 1 can be provided by modifying the general composition of the outer material 70 that circumscribes the inner core 100 of the smokable rod 20. In one representative embodiment, at least a portion of the outer material 70 can be combined with aerosol forming material. For example, some amount or all of the outer material can be in intimate contact with aerosol forming material. In another representative embodiment, at least a portion of the outer material 70 can be combined with burn suppressing agent. For an embodiment incorporating burn suppressing agent within both the inner material 80 and outer material 70, it is preferable that the outer material incorporate an amount and type of burn suppressing agent sufficient to provide a higher degree of burn suppression.

Further embodiments of the smoking article 10 shown in FIG. 1 also can be provided by modifying the general compositions of both of the inner material 80 and the outer material 70 of the smokable rod 20. In one representative embodiment, at least a portion of the outer material 70 can be combined with aerosol forming material, but not with any appreciable amount of burn suppressing agent; while at least a portion of the inner material 80 can be combined with burn suppressing agent, but not with an appreciable amount of aerosol forming material. In another representative embodiment, at least a portion of the inner material 80 can be combined with aerosol forming material, but not with any appreciable amount of burn suppressing agent; while at least a portion of the outer material 70 can be combined with burn suppressing agent, but not with any appreciable amount of aerosol forming material.

Figure 2:
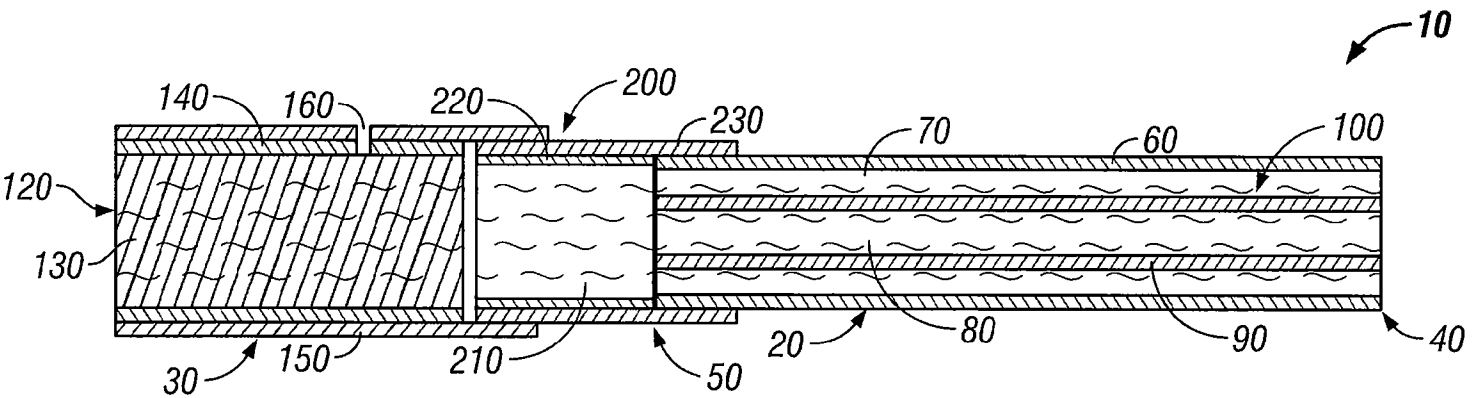

Referring to FIG. 2, cigarette 10 incorporates the components and configuration essentially as set forth in FIG. 1. The cigarette 10 possesses a smokable rod 20 having an inner core of smokable material 80, an optional wrapping material 90 for that smokable material, an outer smokable material 70 circumscribing the inner smokable material, and an outer wrapping material 60. The cigarette also possesses a mouth end piece 30, such as a filter element 120. A cylindrical segment 200 of smokable material 210 is positioned between the mouth end 50 of the smokable rod 20 and the filter element 120. That segment 200 is composed of smokable material 210 (e.g., tobacco cut filler) circumscribed by a cigarette paper wrapping material 220. The segment 200 can have the general configuration of a traditional type smokable rod that is used for cigarette manufacture, and manners and methods for producing those types of segments by subdividing a continuous smokable rod into segments of the desired lengths are set forth generally in U.S. patent application Ser. Nos. 10/324,418, filed Dec. 20, 2002; 10/440,290, filed May 16, 2003; and 10/645,996, filed Aug. 22, 2003. An overlayer 230 of cigarette paper (e.g., that acts as a form of tipping material) circumscribes the outer surface of the wrapping material 220 of the segment 200 and the outer wrapping material 60 of smokable rod 20 over a portion an adjacent region of the smokable rod. Manners, methods and equipment for combining cylindrical segments of cigarette components, such as plug-tube combining techniques, will be readily apparent to those skilled in the art of cigarette design and manufacture. The segment 200 and filter element 120 are positioned adjacent one end of the smokable rod 20, such that the filter element, segment and smokable rod all are axially aligned in an end-to-end relationship, preferably abutting one another. The general cross-sectional shapes and dimensions of the smokable rod 20, segment 200 and filter element 120, when viewed transversely to the longitudinal axis of the cigarette 10, are essentially identical to one another. The ends of the filter element 120 and segment 200 both are open to permit the passage of aerosol therethrough. The filter element 120 includes filter material 130 (e.g., plasticized cellulose acetate tow) that is overwrapped along the longitudinally extending surface thereof with circumscribing plug wrap material 140. Tipping material 150 is used to attach the filter element to the smokable rod, such that the segment 200 is located between the smokable rod and the filter element. The cigarette can possess a series of air dilution perforations 160.

The cigarette 10 is used in much the same manner as the cigarette that is set forth previously with reference to FIG. 1. However, the aerosol formed during burning of the smokable rod 20 is drawn through the segment 200 prior to being drawn through the filter element 120 and into the mouth of the smoker. If desired, the smoker also can allow the cigarette to burn down through the segment 200, and hence, draw tobacco smoke produced as a result of the burning of a portion of that segment. Alternatively, the smoker can smoke the longitudinally segmented portion of the smokable rod of the cigarette up until the point that the firecone approaches the segment 200.

Figure 3:
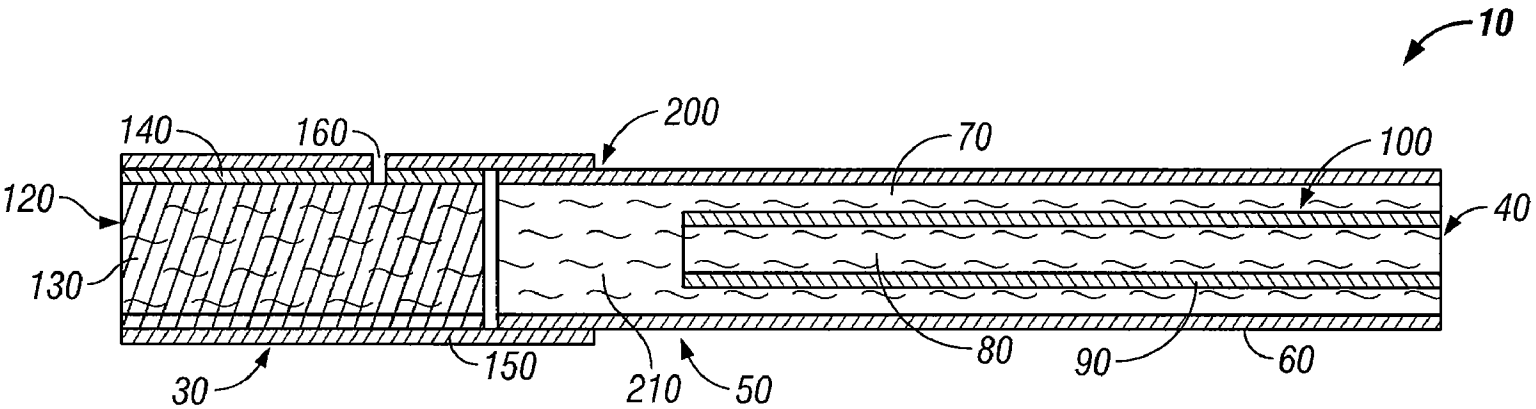

Referring to FIG. 3, cigarette 10 incorporates the components and configuration essentially as set forth in FIG. 1. The cigarette 10 possesses a smokable rod 20 having an inner core of smokable material 80 treated with burn suppressing agent, an optional wrapping material 90 for that material, an outer region smokable material 70 circumscribing the inner material, and an outer wrapping material 60. The cigarette also possesses a mouth end piece 30, such as a filter element 120. A cylindrical segment of smokable material 200 is positioned between the mouth end 50 of the smokable rod 20 and the filter element 120. That segment 200 is composed of smokable material 210 (e.g., tobacco cut filler) circumscribed by the outer wrapping material 220. The segment 200 can be provided by not extending the inner core material entirely through the entire length of the smokable rod 20; and hence, the segment is composed of the type of material used to provide the smokable material of the outer region 70 of that rod. The segment 200 is located at the mouth end 50 of the smokable rod 20, and the filter element 120 is positioned adjacent to the segment, such that the filter element, segment and smokable rod all are axially aligned in an end-to-end relationship, preferably abutting one another. The general cross-sectional shapes and dimensions of the smokable rod 20, segment 200 and filter element 120, when viewed transversely to the longitudinal axis of the cigarette 10, are essentially identical to one another. The ends of the filter element 120, and the ends of both portions of the smokable rod 20 (i.e., the concentric portion and the segment portion) all are open to permit the passage of aerosol therethrough. The filter element 120 includes filter material 130 (e.g., plasticized cellulose acetate tow) that is overwrapped along the longitudinally extending surface thereof with circumscribing plug wrap material 140. Tipping material 150 is used to attach the filter element to the smokable rod, such that the segment 200 is located between the smokable rod 20 and the filter element 120. The tipping material 150 can extend over the outer wrapping material 60 of the smokable rod 20 such that an observant smoker will be inclined not to allow the smokable rod to burn down through the segment (as is shown). Alternatively, the tipping material 150 can be selected so that the smoker can allow the smokable rod to burn through at least a portion of the segment 200. The cigarette can possess a series of air dilution perforations 160.

The cigarette 10 is used in much the same manner as the cigarette that is set forth previously with reference to FIG. 1. However, the aerosol formed during use of the smokable rod 20 is drawn through the segment 200 prior to being drawn through the filter element 120 and into the mouth of the smoker.

Figure 4:
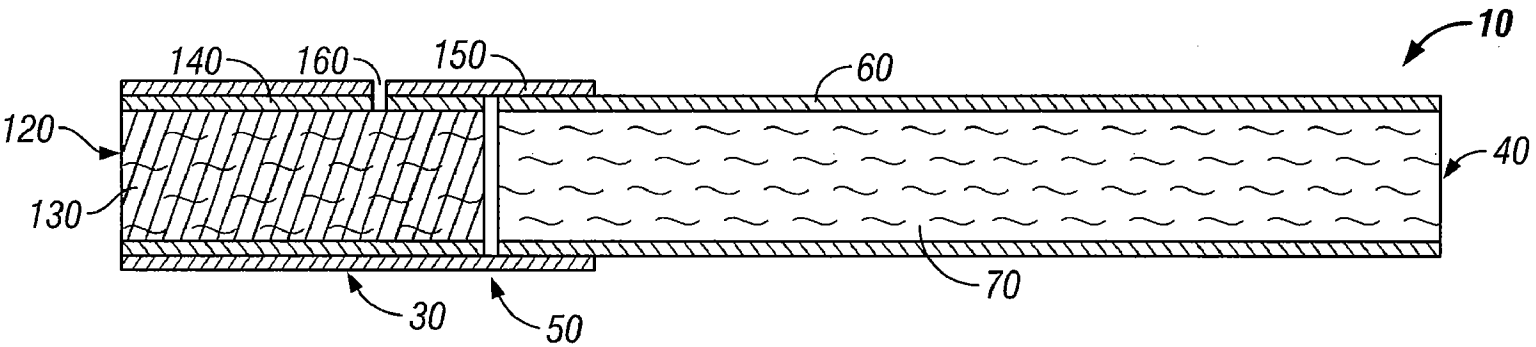

Referring to FIG. 4, a representative preferred smoking article 10 in the form of a cigarette is shown. The smoking article 10 has rod-like shape. The cigarette 10 includes a generally cylindrical smokable rod 20; and a generally cylindrical mouth end piece 30 positioned at one end of that smokable rod. As such, the cigarette 10 possesses a lighting end 40 and a mouth end 50. Such a smokable rod 20, and a cigarette 10 incorporating that rod, can be manufactured using conventional types of manufacturing techniques and equipment. See, for example, the general types of equipment and methodologies set forth in U.S. patent application Ser. Nos. 10/324,418, filed Dec. 20, 2002; 10/440,290, filed May 16, 2003; and 10/645,996, filed Aug. 22, 2003; which are incorporated herein by reference in their entireties.

The smokable rod 20 possesses an outer wrapping material 60. A smokable material 70 is disposed within, and circumscribed by, the outer wrapping material 60. As such, the longitudinally extending outer surface of the smokable rod 20 is provided by the outer wrapping material 60. A representative smokable material 70 is a plant-derived material (e.g., tobacco material in cut filler form). An aerosol forming material (not shown) can be located in the region occupied by the smokable material 70, and as such, at least a portion of that material can act as a substrate for that aerosol forming material. At least a portion of the smokable material 70 can be treated in such a manner that the material does not exhibit a tendency to burn, but rather, that material exhibits a propensity to smolder or char.

The cigarette 10 normally includes a filter element 120, or other suitable mouthpiece, positioned at the mouth end 50 thereof. Both ends of the smokable rod 20, and both ends of the filter element 120, preferably are open to allow the passage of air and aerosol therethrough. General details concerning the construction and positioning of the filter element 120 are set forth previously with reference to FIG. 1. The filter element 120 includes filter material 130 overwrapped along the longitudinally extending surface thereof with circumscribing plug wrap material 140. The filter element 120 is attached to the smokable rod 20 by tipping material 150; and the cigarette 10 can be air diluted by providing a series of perforations 160, each of which extend through the tipping material 150 and plug wrap material 140.

During use, the smoker lights the lighting end 40 of the cigarette 10 using a match or cigarette lighter, in a manner similar to the way that conventional cigarettes are lit. As such, smokable material 70, or at least a portion of the smokable material 70, undergoes smolder, charring or other comparable type of thermal decomposition. The mouth end 50 of the cigarette 10 is placed in the lips of the smoker. Smoke generated by that thermally degrading smokable material 70 is drawn through the cigarette 10 from the smokable rod 20, through the filter element 120, and into the mouth of the smoker. Also as a result, aerosol forming material (not shown), located in that region occupied by the smokable material 70, is volatilized and entrained in the air that is drawn through that region of the smokable rod 20 of the cigarette 10. The aerosol so formed also is drawn through the filter element 120 and into the mouth of the smoker, along with the aerosol (i.e., smoke) formed as a result of the thermal degradation of the smokable material 70. Due to the essentially random nature of the positioning of the cut filler in the smokable rod, the aerosol generated within the rod passes through a rather tortuous, random path defined by the air spaces between pieces of cut filler, as opposed to a hollow passageway of the type that is formed within a formed (e.g., extruded or molded) processed smokable material. For a preferred cigarette, the smokable material 70 and outer wrapping material 60 burn down, essentially as is the case for a traditional tobacco burning cigarette; while at least a portion of the smokable material treated with burn suppressing agent undergoes smolder, charring, or similar change in character, rather than burning. For a highly preferred cigarette, the thermal decomposition of the various components of the smokable rod occur at comparable linear rates along the length of that rod, and as such, a coal or burning tip region produced during consumption of the smokable rod resembles in many regards the type of coal or burning tip of a traditional tobacco burning cigarette. Ash and charred materials that result as the hot coal passes from the lighting end to the mouth end can be flicked, or otherwise removed from the cigarette, essentially in the manner that ash generated from burned tobacco cut filler is removed from a traditional type of tobacco burning cigarette.

The dimensions of representative cigarettes of the type shown in FIG. 1 and FIG. 4 can vary. Typical cigarettes are cylindrically shaped rods having circumferences of about 20 mm to about 27 mm, and preferably about 22 mm to about 25 mm. Typical cigarettes are cylindrically shaped rods that have overall lengths of about 80 mm to about 120 mm, and generally have overall lengths of about 83 mm to about 100 mm. Typical filter elements have lengths of about 20 mm to about 40 mm, and generally about 25 mm to about 35 mm; and typical smokable rods generally have lengths of about 50 mm to about 70 mm.

The dimensions of representative cigarettes of the type shown in FIG. 2 and FIG. 3 can vary. Typical cigarettes are cylindrically shaped rods having circumferences of about 20 mm to about 27 mm, and preferably about 22 mm to about 25 mm. Typical cigarettes are cylindrically shaped rods that have overall lengths of about 80 mm to about 120 mm, and generally have overall lengths of about 83 mm to about 100 mm. Typical filter elements have lengths of about 20 mm to about 40 mm, and generally about 25 mm to about 35 mm; and typical smokable rods generally have lengths of about 50 mm to about 70 mm. The segment located between the smokable rod and the filter element has a length that can vary; but typically the length of that segment is about 5 mm to about 30 mm, generally about 10 mm to about 15 mm.

The cross-sectional dimensions of the smokable rod can vary. Typically, the cross-sectional area of the inner or core cylinder of a co-axial rod makes up about 25 to about 65, often about 35 to about 60 percent of the total cross-sectional area of the smokable rod; while the cross-sectional area of the outer or circumscribing portion of a co-axial rod makes up about 35 to about 75, often about 40 to about 65 percent of the total cross-sectional area of the smokable rod. For example, for a generally cylindrical smokable rod having a circumference of about 24 mm to about 26 mm, a representative inner or core portion has a generally cylindrical shape and a circumference of about 13 mm to about 19 mm.

The smokable rod, components of the smokable rod, the filter element, components of the filter element, the optional segment, components of the optional segment, and the cigarette resulting from the combination smokable rod, filter element and optional segment, can be manufactured using conventional types of cigarette and cigarette component manufacturing techniques and equipment. The various component parts and pieces can be processed and assembled into cigarettes using the conventional types of technologies known to those skilled in the art of cigarette design and manufacture.

The manner by which the co-axial or concentric type of smokable rod is assembled can vary. In one regard, a small circumference rod is manufactured, and filler material and an outer wrapping material is fashioned around that inner rod. In another less preferred regard, an outer rod with a central cavity or passageway is formed, and a small circumference inner rod is positioned in that central cavity. Methods for manufacturing small circumference inner rods for smoking articles are known to those skilled in the art of cigarette manufacture, and those techniques have been used to manufacture rods of small circumference for those cigarettes marketed commercially as "Capri" by Brown and Williamson Tobacco Corporation and "Virginia Slims Superslims" by Philip Morris Inc. Representative manners and methods for manufacturing a smokable rod having a core region of wrapped filler surrounded by an annular region or sheath of filler are set forth in U.S. Pat. Nos. 4,727,888 to Luke; and PCT WO 98/57556 to Biggs et al.; which are incorporated herein by reference. Equipment and techniques such as those set forth in U.S. Pat. No. 5,105,838 to White et al., which is incorporated herein by reference, can be suitably modified and employed. Representative manners and methods for manufacturing a tobacco rod having a core region of one type of smokable filler surrounded by an annular region or sheath of another type of smokable filler are set forth in U.S. Pat. Nos. 3,736,941 to Molins et al.; 3,987,804 to Molins et al.; 4,580,579 to Wahle et al.; 4,593,704 to Wahle et al.; which are incorporated herein by reference.

Smokable materials and other associated materials useful for carrying out the present invention can vary. Smokable materials are material that can be incorporated into the smokable rod, and provide mass and bulk to some region within that smokable rod. Smokable materials undergo some type of destruction during conditions of normal use of the smokable rod into which they are incorporated. Destruction of the smokable material, due at least in part to thermal decomposition of at least some component of that smokable material, results in the formation of an aerosol.

It is most highly preferred that smokable materials incorporate tobacco of some form. Preferred smokable materials are composed predominantly of tobacco of some form, based on the dry weights of those materials. That is, the majority of the dry weight of that material, and the majority of the weight of a mixture incorporating that material (including a blend of materials, and a material having additives applied thereto or otherwise incorporated therein) is provided by tobacco of some form. For example, those materials can be processed tobaccos that incorporate minor amounts non-tobacco filler materials (e.g., calcium carbonate particles, carbonaceous materials, grains or wood pulp), and/or binding agents (e.g., guar gum, sodium alginate or ammonium alginate); and/or a blend of those materials can incorporate tobacco substitutes or extenders. Those materials, and blends incorporating those materials, frequently are composed of greater than about 70 percent tobacco, often are greater than about 80 percent tobacco, and generally are greater than about 90 percent tobacco, on a dry weight basis, based on the combined weights of the tobacco, non-tobacco filler material, and non-tobacco substitute or extender. Those materials can be shredded tobacco that has been cured and aged (e.g., lamina), and/or those materials can be tobacco materials that are in processed forms. It is highly preferred that essentially all (e.g., virtually 100 percent by weight) of the smokable material be composed of tobacco of some form.

Smokable materials typically are used in forms, and in manners, that are traditional for the manufacture of smoking articles, such as cigarettes. For example, those materials normally are used in cut filler form (e.g., shreds or strands of tobacco filler cut into widths of about 1/10 inch to about 1/60 inch, preferably about 1/20 inch to about 1/35 inch, and in lengths of about 1/8 inch to about 3 inches, usually about 1/4 inch to about 1 inch). Tobacco materials can include, or can be derived from, various types of tobaccos, such as flue-cured tobacco, burley tobacco, Oriental tobacco or Maryland tobacco, dark tobacco, dark-fired tobacco and Rustica tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobacco materials are those that have been appropriately cured and aged.

Typically, tobacco materials are used in a so-called "blended" form. For example, certain popular tobacco blends, commonly referred to as "American blends," comprise mixtures of flue-cured tobacco, burley tobacco and Oriental tobacco. Such blends, in many cases, contain tobacco materials that have processed forms, such as processed tobacco stems (e.g., cut-rolled stems, cut-rolled-expanded stems or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). Tobacco reconstitution processes traditionally convert portions of tobacco that normally might be wasted into commercially useful forms. For example, tobacco stems, recyclable pieces of tobacco and tobacco dust can be used to manufacture processed reconstituted tobaccos of fairly uniform consistency. The precise amount of each type of tobacco within a tobacco blend used for the manufacture of a particular cigarette brand can vary, is a manner of design choice, depending upon factors such as the sensory characteristics desired. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999).

Various representative tobacco types, processed types of tobaccos, types of tobacco blends, cigarette components and cigarette configurations are set forth in U.S. Pat. Nos. 4,836,224 to Lawson et al.; 4,924,888 to Perfetti et al.; 5,056,537 to Brown et al.; 5,159,942 to Brinkley et al.; 5,220,930 to Gentry; 5,360,023 to Blakley et al.; and 5,714,844 to Young et al.; US Pat. Applications 2002/0000235 to Shafer et al.; 2003/0075193 to Li et al.; and 2003/0131859 to Li et al.; PCT WO 02/37990 to Bereman; U.S. patent application Ser. No. 10/285,395, filed Oct. 31, 2002, to Lawson et al.; U.S. patent application Ser. No. 10/463,211, filed Jun. 17, 2003, to Perfetti et al.; and Bombick et al., *Fund. Appl. Toxicol.*, 39, p. 11-17 (1997); which are incorporated herein by reference. One representative American blend is provided by combining about 60 to about 70 weight percent flue-cured tobacco lamina, about 12 to about 20 weight percent burley tobacco lamina, about 15 to about 20 weight percent Oriental tobacco, about 15 to about 20 weight percent reconstituted tobacco sheet manufactured from flue-cured and/or Oriental tobacco leaf, about 20 to about 30 weight percent volume expanded flue-cured tobacco lamina, optionally about 10 to about 15 weight percent expanded flue-cured tobacco stems, and optionally a casing material in an amount of about 3 to about 5 weight percent. Another representative American blend is provided by (i) combining about 20 weight parts burley tobacco, about 30 weight parts flue-cured tobacco, about 25 weight parts reconstituted tobacco material (e.g., a reconstituted tobacco made using a papermaking process), and about 25 weight parts Oriental tobacco; (ii) applying about 3 weight parts of an aqueous casing material, comprised of humectants and flavors, and cutting into filler form; (iii) combining the foregoing with about 30 weight parts of a DIET-type expanded tobacco filler (e.g., a blend composed of about 65 weight parts expanded flue-cured shredded lamina and about 35 weight parts expanded burley shredded lamina) to prepare the final cut filler; and then (iv) conditioning the blend to a moisture content of about 12 to about 13 weight percent. Portions of that blend (e.g., those non-volume expanded tobacco filler components) can be cased and top dressed. Tobacco materials also can be used in an essentially "unblended" form. For example, the tobacco material can be made up of on one type of tobacco (e.g., only burley tobacco or only flue-cured tobacco), or one type of processed tobacco (e.g., only volume expanded tobacco laminae, only reconstituted tobacco cut filler, or only shredded tobacco stems).

A variety of materials can be used to provide the material for the portion or portions of the smokable rod that is intended to burn to yield tobacco smoke. The selection of tobacco types and tobacco blends can determine the chemical composition of, and the characteristics of, that aerosol produced when that tobacco or tobacco blend is burned. That material incorporates tobacco of some form, normally is composed predominantly of tobacco, and can be provided by virtually all tobacco material. The form of the smokable material can vary; but most preferably the smokable material is employed in an essentially traditional filler form (e.g., as cut filler). Smokable materials, such as processed tobacco materials, can be used in other forms (e.g., as longitudinally extending strands or as sheets formed into the desired configuration). The smokable material can be treated with tobacco additives of the type that are traditionally used for the manufacture of cigarettes, such as casing and/or top dressing components.

It is desirable to produce a mainstream aerosol that incorporates relatively low levels of incomplete combustion products, pyrolysis products, and other thermal degradation products of tobacco. However, it also is desirable to provide mainstream aerosol possessing the desirable sensory characteristics traditionally associated with those incomplete combustion products, pyrolysis products, and other thermal degradation products of tobacco. For this reason, it is desirable to manufacture a smokable rod that generates a relatively low amount of smoke, and it is desirable that the smoke so generated, be considered to be highly flavorful and as having a relatively great degree of strength. Those types of tobaccos can be obtained by selection of certain cultivars (e.g., by employing certain amounts of Bafra, Samsun and Agonya types of Oriental tobaccos). Those types of tobaccos also can be provided by suitable selection of upper stalk leaves from flue-cured, burley and Oriental tobaccos. Those tobaccos and blends incorporating those types of tobaccos are preferred, because the smoker can be provided with aerosol possessing a desirably high degree of tobacco flavor, organoleptic sensations and satisfaction, while ingesting a significantly reduced overall amount of smoke generated by the burning of tobacco.

A variety of materials can be used to provide the material for that portion of the smokable rod that acts as a substrate for the aerosol forming material. That material incorporates tobacco of some form, normally is composed predominantly of tobacco, and can be provided by virtually all tobacco material. The form of the smokable material can vary; but most preferably the smokable material is employed in an essentially traditional filler form (e.g., as cut filler). Smokable materials, such as processed tobacco materials, can be used in other forms (e.g., as longitudinally extending strands or as sheets formed into the desired configuration). The smokable material can be treated with tobacco additives of the type that are traditionally used for the manufacture of cigarettes, such as casing and/or top dressing components. The smokable material can be treated with burn suppressing agent.

A variety of materials can be used to provide the optional section or segment that is positioned between the smokable rod and the filter element. The material most preferably is a smokable material. The material can incorporate the same types of components used to provide the materials of the smokable rod that are intended to burn to yield tobacco smoke, that act as substrates for aerosol forming materials, or that are treated with burn suppressing agent. The form of the material can vary; but most preferably the material is employed in an essentially traditional filler form (e.g., as cut filler). That material most preferably incorporates tobacco of some form, normally is composed predominantly of tobacco, and can be provided by virtually all tobacco material. Smokable materials, such as processed tobacco materials, can be used in other forms (e.g., as longitudinally extending strands or as sheets formed into the desired configuration). The material can be treated with tobacco additives of the type that are traditionally used for the manufacture of cigarettes, such as casing and/or top dressing components.

At least some portion of the smokable material of the smokable rod is treated with an agent capable of having an effect upon the thermal decomposition properties of the smokable material with which that agent is in intimate contact; and such an agent is referred to as a "burn suppressing agent." That agent preferably is an additive that provides the smokable material with the ability to char or smolder. That is, an exogenous component is placed in intimate contact with at least some portion of the smokable material of the smokable rod. The presence of additive in intimate contact with the smokable material acts to decrease the tendency of that material to burn, at least under those conditions experienced during normal use of the smokable rod. A relatively wide variety of additive materials can be used to achieve such a purpose. See, for example, *Fire Retardants*, EHC 192 (1997). Smokable material in intimate contact with burn suppressing agent is a smokable material that is in physical contact with that agent, such that the agent is capable of providing the desired effect to that smokable material. A smokable material in intimate contact with burn suppressing agent can be surface treated with that agent, or can be treated so that the agent is impregnated within the physical structure of that material.

Most preferably, the burn suppressing agent is of an effective type, and is employed in an effective amount. That is, the burn suppressing agent is a material, or mixture of materials, that can act to lower the overall temperature experienced by the smokable material with which that agent is in intimate contact, and hence can act to effectively inhibit the propensity or ability of that smokable material to burn, at least during normal conditions of use of the smokable rod. Furthermore, the amount of a particular burn suppressing agent with which the smokable material is in intimate contact is sufficient to (i) decrease the propensity of the smokable material to undergo what can be considered normal burning of that smokable material, (ii) allow smolder, charring or other thermal degradation of the smokable material, and (iii) avoid introduction of a high degree of thermal decomposition retardant properties to that smokable material. That is, it is desirable for the smokable rod to possess some amount of treated smokable material such that under conditions of normal use of the smokable rod, the treated smokable material (i) undergoes some type of non-complete burning type of thermal decomposition (e.g., undergoes smolder but does not burn), and (ii) sustains smolder as desired. Typically, undesirable excess addition of a particular burn suppressing agent to the smokable material results in a treated smokable material that tends to not undergo any significant visible thermal decomposition (e.g., the smokable material does not sustain smolder). Typically, insufficient addition of a particular burn suppressing agent to the smokable material results in a treated smokable material that tends to undergo a more complete combustion that is desired.

The burn suppressing agent can vary. Typically, the burn suppressing agent is a material that is compatible with the other components of the smokable rod. It also is desirable that the burn suppressing agent not introduce an unacceptable level of undesirable sensory attributes to the smokable rod, and to the aerosol generated during the use of a cigarette incorporating that smokable rod. Preferred burn suppressing agents are additive materials that undergo some type of phase change and/or chemical change when exposed to those conditions of heat and temperature normally experienced by smokable materials (e.g., tobacco cut filler) in the smokable rod when that smokable rod is consumed during normal use. The additive material can be a salt, such as a water soluble salt. Preferred salts are salts possessing alkali metal ions (e.g., sodium salts and potassium salts). Exemplary salts include alkali metal carboxylates (e.g., potassium citrate, potassium succinate, potassium malate, potassium acetate, potassium tartrate, potassium oxalate, sodium citrate, sodium succinate, sodium acetate, and sodium malate). Other exemplary salts include alkali halides (e.g., sodium chloride and potassium chloride). Other burn suppressing agents also can include potassium hydroxide, sodium hydroxide, sodium borate decahydrate, boric acid, phosphonium salts (e.g., trihydrophosphate acetate), sodium carbonate, potassium carbonate, ammonium borate, ammonium sulfamate, monoammonium phosphate, diammonium phosphate and ammonium carbamate phosphate. The burn suppressing agent can be composed of one suitable material. However, the burn suppressing agent can be composed of a mixture of various materials, and depending upon the characteristics of a particular burn suppressing material, it can be highly desirable to employ a suitable mixture of materials. For example, burn suppressing agents can be formulations incorporating (i) potassium chloride and potassium succinate, (ii) sodium citrate, potassium malate and potassium tartrate, or (iii) boric acid, potassium succinate and potassium citrate. See, for example, Mattina, 39$^{th}$ *TCRC* (1985); *Tobacco Production, Chemistry and Technology*, Davis et al. (Eds.) (1999); and Liu et al., *Beitr. Tabakforsch. Int.,* 20: 341-347 (2003).

The amount of exogenous burn suppressing agent that is applied to, or otherwise placed in intimate contact with, the smokable material, can vary. The amount of any particular burn suppressing agent typically depends upon the ability of agent to prevent the smokable material from undergoing a more complete type of burning, while still allowing that smokable material to smolder, char, or otherwise undergo some type of lower temperature thermal decomposition. For example, highly effective alkali metal chlorides generally can be employed in lower amounts than moderately effective alkali metal carboxylates. Typically, the optimum amount of burn suppressing agent that is employed for treatment of a particular smokable material or smokable blend can be determined by experimentation; and can be in the range of about 1 percent to about 20 percent, based on the dry weight of the smokable material with which that agent is combined. However, the amount of alkali metal carboxylate, such as potassium citrate, added to a smokable material is such that the smokable material so placed in intimate contact with such an exogenous additive frequently possesses at least about 3 percent, often possesses at least about 5 percent, generally possesses at least about 6 percent, usually at least about 8 percent, and sometimes possesses at least about 10 percent, of that additive, based on the dry weight of the smokable material with which that additive is combined. Generally, the amount of alkali metal carboxylate, such as potassium citrate, added to a smokable material is such that the smokable material so placed in intimate contact with such an exogenous additive usually possesses less than about 20 percent, frequently possesses at less than about 15 percent, and often possesses less than about 13 percent, of that additive, based on the dry weight of the smokable material with which that additive is combined.

Modifications to the smokable rod can be made to account for changes in performance characteristics of that rod due to the presence of the burn suppressing agent within at least a portion of the smokable material of that rod. For example, if use of burn suppressing agent results in the production of a smokable rod that exhibits an increased resistance to draw, then the smokable material within that rod can be less tightly packed and/or an increased level of volume expanded tobacco filler can be employed within the smokable blend. Alternatively, if a concentric smokable rod possessing an outer region of smokable material treated with burn suppressing agent smolders much slower that the linear rate at which the inner core of smokable material burns, then the filler material of the inner core can be more tightly packed and/or chemical treatments to the wrapping materials of the concentric rod can act to assist in ensuring that the two segments are consumed at a more even linear rate. Furthermore, if a smokable rod possessing smokable material treated with burn suppressing agent produces an ash that is overly strong or undesirably cohesive, then further chemical treatment of the smokable material and/or the wrapping material of the smokable rod can act to assist in achieving a smokable rod possessing more acceptable ashing qualities.

For a smokable rod, the amount of smokable material treated with burn suppressing agent can vary. Some or all of the smokable material that is a substrate for the aerosol forming material can be treated with burn suppressing agent. Some or all of the smokable material making up the other portion of the smokable material of the smokable rod can be treated with burn suppressing agent. Typically, for smokable rods having higher levels of aerosol forming materials, higher levels of the smokable materials within those rods can incorporate smokable materials that are in intimate contact with burn suppressing agent.

For certain smokable rods, virtually all of the smokable material within those rods can be treated with some amount of burn suppressing agent. However, less than 100 percent, generally less than about 90 percent, often less than about 80 percent, and frequently less than about 70 percent, of the total dry weight of the smokable material within a smokable rod can be smokable material that has been treated with an effective amount of burn suppressing agent. Typically, more than about 15 percent, generally more than about 20 percent, often at least about 25 percent, and frequently more than about 30 percent, of the total dry weight of the smokable material within a smokable rod is smokable material that has been treated with an effective amount of burn suppressing agent.

Smokable material of the smokable rod, including smokable material that is treated with the intention of causing that material to smolder during use, can act as a carrier or substrate for an aerosol forming material. The aerosol forming material can vary, and mixtures of various aerosol forming materials can be used. Representative types of aerosol forming materials are set forth in U.S. Pat. Nos. 4,793,365 to Sensabaugh, Jr. et al.; and 5,101,839 to Jakob et al.; PCT WO 98/57556 to Biggs et al.; and *Chemical and Biological Studies on New Cigarette Prototypes that Heat Instead of Burn Tobacco*, R. J. Reynolds Tobacco Company Monograph (1988); which are incorporated herein by reference. A preferred aerosol forming material produces a visible aerosol upon the application of sufficient heat thereto, and a highly preferred aerosol forming material produces an aerosol that can be considered to be "smoke-like." A preferred aerosol forming material is chemically simple, relative to the chemical nature of the smoke produced by burning tobacco. A highly preferred aerosol forming material is a polyol, such as glycerin.

The smokable material composition most preferably is composed predominantly of tobacco of some form of tobacco and aerosol forming material, based on the dry weight of that composition. That is, the majority of the dry weight of that composition is provided by tobacco and aerosol forming material. Such a composition frequently is composed of greater than about 70 percent tobacco and aerosol forming material, often greater than about 75 percent tobacco and aerosol forming material, and generally greater than about 85 percent tobacco and aerosol forming material, on a dry weight basis. However, due to the presence of other ingredients within the smokable material composition (e.g., flavoring agents), such a composition can be composed of less than about 95 percent tobacco and aerosol forming material, on a dry weight basis.

The amount of aerosol forming material employed relative to the dry weight of smokable material present in a smokable rod can vary. For a smokable rod, the amount of aerosol forming material present in that rod is more than about 2 percent, and generally is more than about 3 percent, of the combined dry weight of the aerosol forming material and tobacco material within that rod. For a preferred smokable rod, the amount of aerosol forming material present in that rod typically is at least about 5 percent, generally is at least about 10 percent, often is at least about 15 percent, frequently is at least about 20 percent, and even can be at least about 25 percent, of the combined dry weight of the aerosol forming material and tobacco material within that rod. For a preferred smokable rod, the amount of aerosol forming material present in that rod typically does not exceed about 65 percent, generally does not exceed about 60 percent, often does not exceed about 55 percent, and frequently does not exceed about 50 percent, of the combined dry weight of the aerosol forming material and tobacco material in that rod. Smokable materials possessing exceedingly high levels of aerosol forming material typically are difficult to process into cigarette rods using conventional types of automated cigarette manufacturing equipment.

Cast sheet types of smokable materials typically can incorporate relatively high levels aerosol forming material. Reconstituted tobaccos manufactured using paper-making types of processes typically can incorporate moderate levels of aerosol forming material. Tobacco strip and tobacco cut fuller can incorporate lower amounts of aerosol forming material. For processed materials, such as cast sheet materials and paper-type reconstituted tobaccos, tobacco pulp materials that are extracted with aqueous liquids can be used as components thereof. The removal of essentially all or some fraction of the water soluble components of tobacco can assist in providing a processed material that is capable of acting as an effective substrate for higher levels of aerosol forming material. In addition, dusting processed materials with dry tobacco powders can assist in providing processed materials having relatively high levels of glycerin while not demonstrating overly tacky or sticky characteristics. Cast sheet materials, and particularly cast sheet materials incorporating certain amounts of tobacco pulp materials that have extracted with water, often can comprise up to about 65 percent, often up to about 60 percent, and frequently up to about 55 percent, aerosol forming material, based on the dry weight of the tobacco and aerosol forming material in the material so produced. Paper-type reconstituted tobacco materials, and particularly those materials incorporating certain amounts of tobacco pulp materials that have extracted with water, and not reapplying some or all of the water soluble extract components back to that pulp, often can comprise up to about 55 percent, often up to about 50 percent, and frequently up to about 45 percent, aerosol forming material, based on the dry weight of the tobacco and aerosol forming material in the material so produced. A material produced by spraying tobacco strip or cut filler with aerosol forming material often does not comprise more than about 20 percent, and frequently does not comprise more than about 15 percent, aerosol forming material, based on the dry weight of the tobacco and aerosol forming material of the material so produced.

Other types of materials incorporating relatively high levels of aerosol forming material can be incorporated into a smokable material blend. Formed, encapsulated or microencapsulated materials can be employed. Such types of materials are composed primarily of aerosol forming material, and those materials can incorporate some amount and form of tobacco. An example of such a type of material is a film produced by casting and drying an aqueous solution of about 70 weight parts glycerin and about 30 weight parts binder (e.g., citrus pectin, ammonium alginate, sodium alginate or guar gum), and then surface coating that film with about 2 weight parts of a finely divided powder that is provided by milling tobacco lamina.

Smokable materials having appropriate amounts of aerosol forming materials can be processed efficiently and effectively using conventional types of automated cigarette making machinery. Overly high levels of aerosol forming material can cause the smokable material to exhibit a sticky or tacky behavior. Increased levels of aerosol forming material in processed tobaccos having acceptable physical characteristics can be accomplished providing processed tobaccos that are deficient in the amount of water soluble extract components, and using aerosol forming material to replace that amount of tobacco extract portion that has been removed from that processed tobacco. Higher levels of binder also can be used to provide processed materials incorporating relatively high levels of aerosol forming material. Processed materials incorporating relatively high levels of aerosol forming material also can be surface treated using dried, finely ground tobacco particles, such as is set forth in U.S. Pat. No. 5,101,839 to Jakob et al. Alternatively, a tobacco material having a relatively high loading level of aerosol forming material can be dried (e.g., by subjecting the tobacco material to a flow of hot air) to a moisture content of about 4 percent to about 5 percent, by weight; the dried tobacco then can be processed to form smokable rods; and then the smokable rods can be re-equilibrated to a moisture content of about 12 to about 13 weight percent.

If desired, the smokable material that is intended to burn and/or the smokable material that is intended to smolder can be treated with other additive agents. Those materials optionally can be ammoniated (e.g., by treatment with anhydrous ammonia, aqueous ammonium hydroxide, or ammonium salts such as diammonium phosphate). Alternatively those materials can be absent, or virtually absent, of any type of added ammonia (e.g., whether by treatment with anhydrous ammonia, aqueous ammonium hydroxide, or ammonium salts such as diammonium phosphate). Those materials also can be treated with other additives, such as potassium carbonate or sodium bicarbonate. Other materials, such as catalytic agents, nanoparticle compositions, and the like, also can be incorporated within any of the smokable materials of the smokable rod. See, for example, the types of components set forth in U.S. patent application Ser. No. 10/382,244, filed Mar. 5, 2003, to Crooks et al. Typically, the smokable material is not treated with more that about 5 percent of any of those additive agents, based on the dry weight of tobacco material within that smokable material.

The manner by which the aerosol forming material, burn suppressing agent, and other additive agents are contacted with the substrate material (e.g., the tobacco material) can vary. The burn suppressing agent and/or aerosol forming material can be applied to a formed tobacco material, or can be incorporated into processed tobacco materials during manufacture of those materials. See, for example, U.S. Pat. No. 5,249,588 to Brown et al. The burn suppressing agent and/or aerosol forming material can be dissolved or dispersed in an aqueous liquid, or other suitable solvent or liquid carrier, and sprayed onto that substrate material. Casing techniques and equipment are useful for such types of applications. Aerosol forming materials having liquid forms can be sprayed directly onto that substrate material. The materials can be applied in one spraying step, or multiple spraying and drying steps can be employed to provide the desired level of additive formulation to the tobacco material. Those materials can be sprayed onto volume expanded tobacco materials, such as DIET-type expanded tobacco filler, steam expanded tobacco stems or cut rolled expanded stems. Exogenous materials, aerosol forming materials, and other additives can be placed in intimate contact with tobacco materials by processing tobacco materials using the manners and methods set forth in U.S. Pat. Nos. 5,025,812 to Fagg et al.; 5,065,775 to Fagg; 5,131,414 to Fagg et al.; 5,234,008 to Fagg; 5,360,022 to Newton et al.; which are incorporated herein by reference. Exogenous materials, aerosol forming materials, and other additives can be placed in intimate contact with reconstituted tobacco materials manufactured using a paper-making type reconstitution process by applying those additives to a formed sheet, during and/or after the manufacturing process associated with that sheet; or by incorporating those additives into that sheet during the manufacture of that sheet using the general types of techniques set forth in U.S. Pat. No. 5,159,942 to Brinkley et al. Processed tobacco materials incorporating aerosol forming materials and other exogenous materials are set forth in U.S. Pat. Nos. 5,105,836 to Gentry et al.; 5,327,917 to Lekwauwa et al.; 5,101,839 to Jakob et al.; 5,271,419 to Young et al.; 5,598,868 to Jakob et al. and 5,715,844 to Young et al.; which are incorporated herein by reference. Cast sheet types of materials can use a variety of binding agents, including for example, guar gum, xanthan gum, locust bean gum, carrageenans, tragacanths, alginates (e.g., ammonium alginate), and blends of materials (e.g., a blend of xanthan, guar and locust bean gums). Cast sheet type materials can have single layer forms or multi-layer forms. For example, a three layer sheet can possess outer layers comprised principally of tobacco material and binding agent, and an inner or center layer comprised principally of aerosol forming material, a calcium source, and an alginate binder. Multilayer sheet materials can be produced using the types of extrusion equipment available from Cloeren Incorporated.

The aerosol forming material can be in intimate contact with a processed tobacco material that is processed such that at least a portion of a solvent soluble portion of the tobacco material is removed therefrom and such that the processed tobacco material is a substrate for the aerosol forming material. Cast sheet materials incorporating aerosol forming material can be manufactured from water extracted tobacco pulp, and the aerosol forming material incorporated into the resulting processed cast tobacco material can replace at least a portion of the tobacco extract portion that is not incorporated within the resulting processed cast tobacco material. Reconstituted tobacco paper-type sheet incorporating aerosol forming material can be manufactured by forming water extracted pulp and applying a mixture of water soluble tobacco extract and aerosol forming material to that pulp. For example, for tobacco materials having hot water soluble contents of about 45 weight percent, formed water extracted pulp portions can have mixtures of glycerin and aqueous tobacco extract applied that can be comprised of (i) about 5 weight parts glycerin and about 40 weight parts tobacco extract, (ii) about 10 weight parts glycerin and about 35 weight parts tobacco extract, (iii) about 15 weight parts glycerin and about 30 weight parts tobacco extract, (iv) about 20 weight parts glycerin and about 25 weight parts tobacco extract, (v) about 25 weight parts glycerin and about 20 weight parts tobacco extract, (vi) about 30 weight parts glycerin and about 15 weight parts tobacco extract, (vii) about 35 weight parts glycerin and about 10 weight parts tobacco extract, or (viii) about 40 weight parts glycerin and about 5 parts tobacco extract.

It is desirable that the smokable materials (and particularly those materials that are treated with burn suppressing agent) not incorporate inorganic filler material. That is, it is preferred that exogenous inorganic filler materials are not added to, or incorporated within, processed materials that are used in carrying out the present invention. Inorganic filler materials can be considered to be those materials that provide some type of bulk to a processed material with which those filler materials are associated, or into which those filler materials are incorporated. Typical inorganic materials are used in particulate form. Exemplary inorganic filler materials are calcium carbonate, perlite, vermiculite, diatomaceous earth materials, colloidal silica, magnesium oxide, magnesium sulfate, magnesium carbonate, and other types inorganic filler materials.

If desired, the smokable materials and other associated materials can be treated with additives in order to improve the ashing characteristics of the smokable rod, or otherwise improve the performance characteristics of that rod. For example, either or both of the materials that make up the inner core or outer portion of the concentric smokable rod can be treated with additives that provide improved ashing characteristics to that rod. Exemplary additives that improve the ashing characteristics of the rod are monoammonium phosphate, potassium phosphate, sodium phosphate, monoammonium acetate, sodium carbonate, and attapulgite clay. Those additives typically are added to the relevant material being treated in amounts of less than about 5 percent, generally less than about 3 percent, based on the dry weight of the material being treated.

For a concentric smokable rod, at least some of the smokable material that is used to provide the segment that is intended to smolder is treated with burn suppressing agent. In such a circumstance, the smokable material that is treated with burn suppressing agent also can be blended with other materials (e.g., tobacco cut filler) that have not been treated with burn suppressing agent. The smokable material that is treated with burn suppression agent can comprise the predominant amount of the portion of the co-axial or concentric rod that is intended to smolder. For example, regions of the smokable rod that are intended to smolder or char during use preferably comprise less than about 30 percent, generally less than about 20 percent, and often less than about 10 percent, of material (e.g., tobacco cut filler) that has not been treated with burn suppressing agent, based on the total combined dry weight of those smokable materials that are treated and untreated with burn suppressing agent. A smokable material that acts as a substrate for the aerosol forming material can be treated with burn suppressing agent. A smokable material that is not used as a substrate for the aerosol forming material can be treated with burn suppressing agent. If desired, two or more smokable materials, each treated with different amounts and/or different types of burn suppressing agents, can be blended together. If desired, two or more smokable materials, each treated with different amounts and/or different types of burn suppressing agents, can be used in different locations within the smokable rod.

The amount of aerosol forming material and burn suppressing agent that is used within the smokable rod is such that the smokable rod exhibits acceptable sensory properties. It is desirable for those components to not introduce significant degrees of unacceptable off-taste, filmy mouthfeel, or an overall sensory experience that is significantly different from that of a traditional type of cigarette. The selection of the burn selection agent, the amount of burn suppressing agent used, and the amount of tobacco material not treated with burn suppressing agent relative to the amount of tobacco material that is treated, can be altered in order to control the overall chemical composition of the aerosol produced by that tobacco material.

Any or all of the smokable material of the smokable rod can further include other added components. For a concentric smokable rod, smokable materials that comprise the optional segment, and/or either or both of the core and outer portions of that smokable rod, can further include other added components. Those added components include casing materials. See, for example, U.S. Pat. Nos. 3,419,015 to Wochnowski; 4,054,145 to Berndt et al.; 4,887,619 to Burcham, Jr. et al.; 5,022,416 to Watson; 5,103,842 to Strang et al.; and 5,711,320 to Martin. Typical casing materials include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al. Additives also can be added to the smokable materials using the types of equipment described in U.S. Pat. No. 4,995,405 to Lettau or that are available as Menthol Application System MAS from Kohl Maschinenbau GmbH. The selection of particular casing and top dressing components is dependent upon factors such as the sensory characteristics that are desired, and the selection and use of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972). Because it is desirable to manufacture a smokable rod that generates a relatively low amount of smoke derived directly from burning tobacco, it can be desirable to employ flavorings and flavor packages that provide flavor, strength and body to an aerosol that might be otherwise perceived as having overall sensory attributes that can be characterized as being an overly bland, weak, mild or unsatisfying. In addition, because it is desirable to manufacture a smokable rod that generates a relatively low amount thermal decomposition products derived directly that is considered to be tobacco that is high in flavor and strength, it can be desirable to employ flavorings and flavor packages that ameliorate some of the negative sensory attributes that might be associated with that aerosol. For example, tobacco that generates smoke that might be considered to be overly harsh or irritating can be combined with organic acids, such as levulinic acid, pyruvic acid, citric acid, lactic acid, acetic acid, malic acid and/or ascorbic acid (e.g., tobacco that produces smoke that might be considered harsh or irritating can be combined with a top dressing formulation incorporating equal amounts of pyruvic acid, lactic acid and levulinic acid, and such top dressing formulation can be employed in an amount sufficient improve the sensory attributes of the mainstream smoke generated by that tobacco). See also, for example, the types of organic acids set forth in U.S. Pat. No. 4,836,224 to Lawson et al.

The amount of smokable material employed to manufacture the smokable rod can vary. For a typical concentric smokable rod of the type described previously with reference to FIGS. 1 through 3, inner core region can possess a greater amount, a lesser amount, or the same amount of smokable material as does the outer region that encircles that inner core. However, for a representative type of concentric smokable rod, the amount of smokable material in the inner core region generally is between about 100 mg and about 250 mg; while the amount of smokable material in the outer region that encircles the core region generally is between about 500 mg and about 1,000 mg. This is, the weight of the inner region typically is less than the weight of the outer region. Furthermore, for a typical concentric smokable rod, the packing density of the smokable material of the inner core region is less than the packing density of the smokable material in the outer region that encircles the core region. The smokable material normally is employed so as to fill the inner core region of the smokable rod at a packing density of less than about 400 mg/cm$^3$, and generally less than about 350 mg/cm$^3$; while the packing density of the smokable material in that inner core region generally exceeds about 100 mg/cm$^3$, and often exceeds about 150 mg/cm$^3$. The smokable material normally is employed so as to fill the region surrounding the inner rod of the smokable rod at a packing density of less than about 650 mg/cm$^3$, generally less than about 600 mg/cm$^3$, and often less than about 550 mg/cm$^3$; while the packing density of the smokable material in that outer region encircling the inner core region normally exceeds about 250 mg/cm$^3$, generally exceeds about 300 mg/cm$^3$, and often exceeds about 350 mg/cm$^3$. For a typical smokable rod of the type described previously with reference to FIG. 4, the packing density of the smokable material within the rod generally is greater than about 100 mg/cm$^3$, and often is greater than 150 mg/cm$^3$; while the packing density of the smokable material within the rod generally is less than about 300 mg/cm$^3$, and often is less than about 250 mg/cm$^3$.

For a concentric smokable rod, the inner core material and the outer circumscribing material are in a heat exchange relationship with one another. The physical arrangement of those materials is such that heat is transferred (e.g., by means that includes conductive heat transfer) from the burning smokable material to the adjacent treated tobacco material, throughout the period that the smokable material is burned during use of smokable rod. Typically, the heat exchange relationship is achieved by positioning those components in close proximity to one another. For example, the inner wrapping material of the smokable rod is used to separate the inner and outer materials from one another.

The smokable material typically burns at a relatively high temperature. Typical smokable materials, such as tobacco cut filler materials, often burn such that maximum coal temperature of a cigarette incorporating those materials reaches about 850° C., and sometimes reaches about 950° C. Typical smokable materials that are treated with suitable amounts of suitable burn suppressing agent typically undergo thermal decomposition (e.g., as smolder or char) at temperatures that usually exceed about 450° C., often exceed about 500° C., and frequently exceed about 550° C. Typical smokable materials, such as tobacco cut filler materials, that are treated with suitable amounts of suitable burn suppressing agent, can generate maximum coal temperatures that do not exceed about 750° C., often do not exceed 700° C., and sometimes do not exceed about 650° C. See, for example, *The Chemistry of Tobacco and Tobacco Smoke*, Schmeltz (ed.) (1972); Baker, *Prog. Ener. Combust. Sci.*, 7: 135-153 (1981); *Proceedings of the International Conference on the Physical and Chemical Processes Occurring in a Burning Cigarette* (Apr. 26-29, 1987); and *Tobacco Production, Chemistry and Technology*, Davis et al. (Eds.) p. 398-439 (1999). Typically, maximum coal temperatures during periods of smolder are lower than maximum coal temperatures during periods of draw. See, for example, Lyman et al., *Beitr. Tabakforsch. Int.*, 20: 381-388 (2003).

The temperatures to which the aerosol forming material and associated substrate material are exposed during use of the smokable rod can vary. Substrate materials can be treated with suitable amounts of suitable burn suppressing agents. For example, appropriately treated substrate materials, such as treated tobacco containing smokable materials, when incorporated into smokable rods, generally undergo smolder or char at temperatures that usually exceed about 450° C., often exceed about 500° C., and frequently exceed about 550° C. Typical appropriately treated substrate materials, when incorporated into smokable rods, generate maximum coal temperatures that do not exceed about 750° C., often do not exceed 700° C., and frequently do not exceed about 650° C.

Smokable materials that are components of the smokable rod (e.g., tobacco materials), and that burn, produce smoke that is made up of gases and particulate materials, and that smoke contains volatilized components of the smokable material, combustion products (e.g., carbon dioxide and water), incomplete combustion products and products of pyrolysis. Materials that are components of the smokable rod (e.g., treated tobacco materials), and that have a tendency not to burn, but rather exhibit a propensity to smolder or char, produce thermal decomposition products. Typically, the levels of combustion products (e.g., in particular, carbon dioxide) generated by materials treated with burn suppressing agents and that undergo smolder or char, rather than a more complete burning, are considerably less than those levels of combustion products generated by the burning of similar materials that are not treated with burn suppressing agents.

The outer wrapping material can vary. Preferably, the outer wrapping material is a paper material, such as the type of paper material typically used in cigarette manufacture. The wrapping material can have a wide range of compositions and properties. The selection of a particular wrapping material will be readily apparent to those skilled in the art of cigarette design and manufacture. Smokable rods can have one layer of wrapping material; or smokable rods can have more than one layer of circumscribing wrapping material, such as is the case for the so-called "double wrap" smokable rods. The wrapping material can be composed of materials, or be suitably treated, in order that the wrapping material does not experience a visible staining as a result of contact with components of the smokable material (e.g., aerosol forming material). Exemplary types of wrapping materials, wrapping material components and treated wrapping materials are described in U.S. Pat. Nos. 5,105,838 to White et al.; 5,271,419 to Arzonico et al. and 5,220,930 to Gentry; PCT WO 01/08514 to Fournier et al.; PCT WO 03/043450 to Hajaligol et al.; US Pat. Application 2003/0114298 to Woodhead et al.; US Pat. Application 2003/0131860 to Ashcraft et al.; and U.S. patent application Ser. Nos. 10/324,418, filed Dec. 20, 2002; 10/440,290, filed May 16, 2003; and 10/645,996, filed Aug. 22, 2003; which are incorporated herein by reference in their entireties. Representative outer wrapping materials are commercially available as R. J. Reynolds Tobacco Company Grades 119,170, 419, 453, 454, 456, 465, 466, 490, 525, 535, 557, 652, 664, 672, 676 and 680 from Schweitzer-Maudit International. Wrapping materials can be treated so as to avoid visible spotting and staining caused by relatively high levels of aerosol forming material. Untreated conventional types of wrapping materials for smokable rods can have the propensity to exhibit spotting and staining caused by the presence of aerosol forming material for tobacco materials sprayed with more than about 5 weight percent aerosol forming material, for paper-type reconstituted tobacco materials incorporating more than about 15 weight percent aerosol forming material, and for cast sheet reconstituted tobacco materials incorporating more than about 35 weight percent aerosol forming material. Colored wrapping materials (e.g., brown colored papers) can be employed. The porosity of the outer wrapping material can vary, and normally is at least about 5 CORESTA units, generally is at least about 10 CORESTA units, often is at least about 15 CORESTA units, and frequently is a least about 20 CORESTA units. The porosity of the outer wrapping material normally is less than about 100 CORESTA units, often is less than about 90 CORESTA units, and frequently is less than about 80 CORESTA units.

The inner wrapping material can vary. Preferably, the inner wrapping material is a paper material, such as the type of paper material typically used in cigarette manufacture. Exemplary types of wrapping materials, wrapping material components and treated wrapping materials are of the types that are set forth previously as being exemplary of the outer wrapping material. Selection of component materials, dyes, or the addition of tobacco components to the wrapping material can provide that wrapping material with a brown color, and hence render that wrapping material less visibly noticeable. Reconstituted tobacco materials also can be used as the inner wrapping materials, and representative reconstituted tobacco materials useful as wrapping materials for smokable rods are set forth in U.S. Pat. Nos. 5,074,321 to Gentry et al.; 5,159,944 to Arzonico et al.; 5,261,425 to Raker; 5,462,073 to Bowen; and 5,699,812 to Bowen; which are incorporated herein by reference. The inner wrapping material also can be a cast sheet type of reconstituted tobacco material, including such a material incorporating a relatively high level of aerosol forming material.

The porosity of the inner wrapping material can vary. The porosity of the inner wrapping material frequently is between about 0 CORESTA unit and about 100 CORESTA units, often is between about 10 CORESTA units and about 90 CORESTA units, and frequently is between about 20 CORESTA units and about 80 CORESTA units. The porosity of the inner wrapping material can exceed 100 CORESTA units, often can exceed about 200 CORESTA units, and frequently can exceed about 500 CORESTA units. Highly porous papers have porosities that can exceed about 1,000 CORESTA units, often can exceed about 3,000 CORESTA units, and frequently can exceed about 5,000 CORESTA units. Certain highly porous papers can exceed about 10,000 CORESTA units. Exemplary highly porous papers are available from Schweitzer-Maudit International as Porowrap Plug Wrap 17-M1, 33-M1, 45-M1, 65-M9, 95-M9, 150-M4, 260-M4 and 260-M4T. Representative types of highly porous wrappers for use in the manufacture of smokable rods are described in Canadian Pat. No. 1,235,039. If desired, inner wrapping materials can be electrostatically perforated to provide wrapping materials having high net porosities.

Smokable rods can possess outer and inner wrapping materials that are the same, or the wrapping materials can be different from one another. A smokable rod can possess outer wrapping material that exhibits a porosity that is the same as that of the inner wrapping material, is less than that of the inner wrapping material, or is greater than that of the inner wrapping material.

The mouth end piece can vary. Preferred mouth end pieces have the form of filter elements. Representative filter element components and designs are described in Browne, *The Design of Cigarettes,* 3rd Ed. (1990); *Tobacco Production, Chemistry and Technology*, Davis et al. (Eds.) 1999; U.S. Pat. Nos. 4,508,525 to Berger; 4,807,809 to Pryor et al.; 4,920,990 to Lawrence et al.; 5,012,829 to Thesing et al.; 5,025,814 to Raker; 5,074,320 to Jones, Jr. et al.; 5,101,839 to Jakob et al.; 5,105,834 to Saintsing et al.; 5,105,838 to White et al.; 5,271,419 to Arzonico et al.; 5,360,023 to Blakley et al; 5,595,218 to Koller et al.; 5,718,250 to Banerjee et al.; and 6,537,186 to Veluz; US Pat. Applications 2002/0014453 to Lilly, Jr. et al.; 2002/0020420 to Xue et al.; 2002/0166563 to Jupe et al.; and 2003/0168070 to Xue et al.; U.S. patent application Ser. No. 10/600,712, filed Jun. 23, 2003, to Dube et al.; PCT WO 02/37990 to Bereman; PCT WO 03/059096 to Paine et al.; and European Patent No. 920816. Representative filter materials can be manufactured from tow materials (e.g., cellulose acetate or polypropylene tow) or gathered web materials (e.g., gathered webs of paper, cellulose acetate, polypropylene or polyester). Certain filter elements can have relatively high removal efficiencies for selected gas phase components of the mainstream aerosol. Certain filter elements can have relatively low filtration efficiencies for the volatilized aerosol forming material.

For cigarettes of the present invention that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and aerosol drawn through the cigarette and exiting the extreme mouth end portion of the cigarette. Higher air dilution levels can act to reduce the transfer efficiency of aerosol forming material into mainstream aerosol.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Filter Test Station (CTS Series) available form Filtrona Instruments and Automation Ltd. or a Quality Test Module (QTM) available from the Cerulean Division of Molins, PLC Cigarettes of the present invention, when smoked, yield an acceptable number of puffs. Such cigarettes normally provide more than about 6 puffs, and generally more than about 8 puffs, per cigarette, when smoked under FTC smoking conditions. Such cigarettes normally provide less than about 15 puffs, and generally less than about 12 puffs, per cigarette, when smoked under FTC smoking conditions. FTC smoking conditions consist of 35 ml puffs of 2 second duration separated by 58 seconds of smolder.

Cigarettes of the present invention, when smoked, yield mainstream aerosol. The amount of mainstream aerosol that is yielded per cigarette can vary. When smoked under FTC smoking conditions, an exemplary cigarette yields an amount of FTC "tar" that normally is at least about 1 mg, often is at least about 3 mg, and frequently is at least about 5 mg. When smoked under FTC smoking conditions, an exemplary cigarette yields an amount of FTC "tar" that normally does not exceed about 25 mg, often does not exceed about 20 mg, and frequently does not exceed about 15 mg.

Preferred cigarettes exhibit yields of FTC "tar" to FTC nicotine of less than about 30. Preferred cigarettes exhibit yields of FTC "tar" to FTC nicotine of more than about 5. Preferred cigarettes exhibit yields of FTC "tar" to FTC carbon monoxide of less than about 2. Techniques for determining FTC "tar" and FTC nicotine are set forth in Pillsbury et al., *J. Assoc. Off. Anal. Chem.,* 52, 458-462 (1969). Techniques for determining FTC carbon monoxide are set forth in Horton et al., *J. Assoc. Off. Anal. Chem.,* 57, 1-7 (1974).

Aerosols that are produced by cigarettes of the present invention are those that are composed of air containing components such as vapors, gases, suspended particulates, and the like. Aerosol components are generated by burning tobacco of some form (and optionally other components that are burned to generate heat), as well as by thermal decomposition of tobacco caused by heating tobacco, smoldering tobacco, and charring tobacco. Aerosol components also are generated by the action of heat from burning tobacco of some form (and optionally other components that are burned to generate heat), upon substances that are located in a heat exchange relationship with tobacco material that is burned and other components that are burned. Preferred aerosols are visible, and most preferably are those aerosols perceived to be "smoke-like."

The composition of the mainstream aerosol can vary. A preferred smokable rod of the present invention provides an aerosol composed of a significant amount of components that are chemically simple (e.g., comprising components such as air, water, aerosol forming material, oxides of carbon, vaporized flavors, and volatilized or other types of components resulting from the thermal decomposition of a tobacco material). In situations in which some or all of the tobacco material is treated with burn suppressing agent, those components can be formed at relatively low thermal decomposition temperatures. The mainstream aerosol is composed of reduced amounts of certain incomplete products of combustion, and pyrolysis products derived from the burning of substances such as tobacco, as compared to the mainstream smoke produced by burning conventional blends of tobacco cut filler in traditional types of tobacco burning cigarettes. Collected condensate of the mainstream aerosol typically possesses a significant amount of water. For example, collected condensate of the mainstream aerosol of a filtered cigarette of the present invention frequently can be composed of greater than about 15 percent water, and often can be composed of greater than about 20 percent water, based on the weight of that collected condensate.

The amount of aerosol forming material within the mainstream smoke of cigarettes of the present invention can vary. The transfer efficiency of aerosol forming material typically is lower, when higher levels of aerosol forming material are incorporated into the smokable rod such that the aerosol forming material is in intimate contact with at least a portion of the smokable material within that rod. The transfer efficiency of aerosol forming material typically is less than about 15 percent, generally less than about 12 percent, often less than about 8 percent, and frequently less than about 5 percent, for cigarettes that are smoked under FTC smoking conditions. For typical cigarette mainstream smoke condensate that is collected during smoking, the amount of aerosol forming material within that condensate usually makes up at least about 30 percent, generally at least about 40 percent, frequently at least about 50 percent, often at least about 60 percent, and sometimes at least about 70 percent, of the total dry weight thereof. For condensate that is collected, the amount of aerosol forming material within that condensate typically makes up less than about 90 percent, and generally less than about 85 percent, frequently less than about 75 percent, of the total dry weight thereof. See, for example, Laurene et al., *Tob. Sci.,* 9: 1-4 (1965).

EXPERIMENTAL

The following examples are provided in order to further illustrate various aspects of the invention but should not be construed as limiting the scope thereof. Unless otherwise noted, all parts and percentages are by weight.

The cigarettes of Example 1 through 5 are prepared as follows. A 100 mm by 25 mm block of "Teflon" brand tetrafluoropolyethylene is positioned in a drill press. A 25 mm circumference hole is drilled through the 100 mm length of the block. The block is cut in half length-wise through the center of the bored hole. Piano hinges are mounted on the block so that the resulting device can be opened length-wise and can securely hold a smokable rod having a circumference of 25 mm. Filtered cigarettes of the desired sizes and dimensions are prepared employing a drill press. A formed tobacco rod possessing an outer wrapping material containing tobacco cut filler, or a formed cigarette possessing a filter element attached to a rod possessing an outer wrapping material containing tobacco cut filler, is provided. The tobacco rod or the cigarette is placed into device, and the device is secured into the base of the drill press. A smooth pointed plastic dowel rod of about 18 mm circumference is placed into the chuck of the drill press, the drill press is turned on, the dowel is slowly plunged down into the tobacco rod that is secured within the device, the dowel rod is allowed to spin slowly in place for about one minute, and then the dowel rod is slowly removed. A straw plastic tube of similar diameter to the dowel rod is slid into the cavity produced so produced within the tobacco rod. In this way, the tobacco filler within the tobacco rod is compressed to form an annulus surrounding the straw. The depth of the cavity produced is determined by the depth that the dowel rod is displaced into the cigarette. Cigarettes of Examples 1 and 2 are produced by plunging the dowel rod the entire length of the tobacco rod, thereby forming inner and outer radially disposed segments that run the entire length of the smokable rod. Cigarettes of Examples 3 through 5 are produced in a similar manner so as to form a cavity of about 50 mm in depth, while allowing for the presence of a cylindrical tobacco filler segment of about 7 mm in length. For the cigarettes of Examples 3 through 5, those segments are positioned adjacent to the filter elements of those cigarettes. A formed inner rod, or filler material for an inner core section, is inserted into the bored hollow region occupied by the straw as the straw is removed from the bored cigarette rod. As such, a cigarette having a smokable rod possessing a co-axial or concentric construction can be provided.

Example 1

A cigarette of the general type described previously with reference to FIG. 1 is provided. The cigarette has a total length of about 84 mm. The cigarette possesses a smokable rod having a length of about 57 mm and a filter element having a length of about 27 mm. When viewed end on, the cigarette has a generally circular cross-sectional shape. The circumference of the smokable rod is about 25 mm.

The inner rod having a generally cylindrical shape is produced by wrapping the smokable material in a wrapping material. The wrapping material circumscribes the smokable material such that the wrapping material and smokable material each extend along the total length of the rod. The wrapping material provides the outer longitudinal surface of the inner rod, and due to the tubular shape of the wrapping material, each end is open to expose the smokable material within that rod. The rod has a length of about 57 mm and a circumference of about 14 mm.

The wrapping material of the inner rod is a 17 mm wide cigarette paper wrapper. The paper wrapper is composed of wood pulp and calcium carbonate. The paper wrapping material has a dry basis weight of about 25 g/m$^2$, a porosity of about 38 CORESTA units, and is available as Tercig LK38 from Tervakoski. The paper wrapper is a type that has been conventionally used for tobacco rod manufacture by R. J. Reynolds Tobacco Company. The wrapping material and side seam adhesive of the inner rod have a combined weight about 27 mg.

The smokable material of the inner rod is a blend of various types of tobaccos, and is the type of blend known as an "American blend." The blend is that type of cased and top dressed tobacco cut filler blend used for the commercial manufacture of cigarettes that are available from R. J. Reynolds Tobacco Company. Each of the cut filler materials are shredded materials that are cut into pieces at about 28 cuts per inch. The blend contains about 17 percent burley tobacco lamina, about 34 percent flue-cured tobacco lamina, about 21 percent reconstituted tobacco material manufactured using the paper-type reconstitution process employed by R. J. Reynolds Tobacco Company and known as "G-7," and about 16 percent Oriental tobacco. The blend is a smokable material that is composed of virtually all tobacco, and no tobacco substitutes, non-tobacco fillers or non-tobacco extenders are used in the blend or within processed tobaccos of the blend. The blend has about 6 percent of an aqueous casing of sugars, cocoa, licorice, glycerin and flavors applied thereto prior to cutting into filler form. About 6 percent DIET-type expanded tobacco filler (which is composed of about 65 percent expanded flue-cured shredded lamina and 35 percent expanded burley shredded lamina), then is added to the cut tobacco blend prior to prepare the final cut filler blend. The moisture content of the tobacco cut filler blend of the inner rod is about 12 percent to about 13 percent. The resulting smokable material of the inner rod weighs about 150 mg. The packing density of the material within the inner smokable rod is about 120 mg/cm$^3$.

The inner rod is positioned within an outer rod. The inner rod is centrally positioned within the outer rod so that the smokable material of the outer rod completely circumscribes the entire length of the inner rod at a radial depth of about 1.5 mm.

The wrapping material of the inner rod is a 27 mm wide cigarette paper wrapper. The paper wrapper is composed of wood pulp and calcium carbonate. The paper wrapping material has a dry basis weight of about 25 g/m$^2$, a porosity of about 38 CORESTA units, and is available as Tercig LK38 from Tervakoski. The wrapping material and a conventional type of side seam adhesive are used to manufacture an outer wrapping material having the shape of a tube possessing a circumference of about 25 mm.

The material that is disposed inside of the outer wrapping material and encircling the inner rod is a blend of tobaccos in cut filler form. About 50 parts of that outer blend is composed of cut filler produced from a cast sheet type of reconstituted tobacco incorporating a relatively high level of glycerin.

About 50 parts of the blend is composed of an "American blend" of tobacco cut filler incorporating various additives. Each of the cut filler materials are shredded materials that are cut into pieces at about 28 cuts per inch.

The cast sheet material is provided by forming an aqueous slurry of about 6 parts guar gum, about 60.7 parts glycerin, about 27 parts of a paper-type reconstituted tobacco manufactured from water extracted burley tobacco (and hence possessing essentially no water soluble extract portion), about 3.6 parts diammonium phosphate, and about 2.7 parts of finely milled particles of burley tobacco lamina. The slurry is mixed and is cast as a sheet, and heat is applied to dry the cast slurry to a moisture content of about 12 to about 13 percent. During casting of the slurry, a top load of finely divided particles of burley tobacco lamina is applied to the sheet, such that the final sheet incorporates about 90 parts of the slurry components and about 10 parts of the milled burley tobacco lamina, on a dry weight basis. That resulting cast sheet material is of the type used as an aerosol generating substrate in the "Eclipse" brand cigarette that is commercially marketed by R. J. Reynolds Tobacco Company. The cast sheet material is treated with potassium citrate. That is, a solution of about 50 percent potassium citrate dissolved in about 50 percent water is applied to the tobacco by spraying. The treated tobacco then is dried to a moisture content of about 12 percent to about 13 percent. The amount of potassium citrate within that treated cast sheet material is about 8 percent, based on the dry weight of the tobacco within that material.

The remaining portion of the blend that provides the outer portion of the concentric rod includes about 8.5 percent burley tobacco lamina, about 17 percent flue-cured tobacco lamina, about 10.5 percent paper-type reconstituted tobacco material, and about 8 percent Oriental tobacco. The blend has about 3 percent of an aqueous casing of sugars, cocoa, licorice, glycerin and flavors applied thereto prior to cutting into filler form. The portion of the blend that includes burley, flue-cured, Oriental and reconstituted tobacco material is treated with potassium citrate, in the manner described previously with reference to the treatment of the cast sheet material. The treated tobacco then is dried to a moisture content of about 12 percent to about 13 percent. Then, the final portion of that blend is provided by mixing the 97 percent of the tobacco blend treated so as to be in intimate contact with potassium citrate with about 3 percent DIET-type expanded tobacco filler (which is composed of about 65 percent expanded flue-cured shredded lamina and 35 percent expanded burley tobacco shredded lamina). The amount of potassium citrate within that treated tobacco blend is about 8 percent, based on the dry weight of the tobacco within that blend.

The treated smokable material blend of the outer portion of the smokable rod weighs about 890 mg. The packing density of the cut filler blend within the outer portion of the smokable rod is about 500 mg/cm$^3$. The filler material that is used to manufacture the outer portion of the smokable rod is composed of virtually all tobacco of some form. The predominant amount of the filler material used to manufacture the outer portion of the smokable rod is treated with a burn suppressing agent (i.e., the exogenous salt); and a portion of the physical blend of that material is composed of a material that consists predominantly of tobacco and aerosol forming material.

The filter element is manufactured using conventional cigarette filter making technology from cellulose acetate tow (2.7 denier per filament, 35,000 total denier) plasticized using triacetin, and circumscribing non-air permeable paper plug wrap. The smokable rod and filter element are aligned in an abutting, end-to-end relationship and secured together using a non-air permeable tipping paper. The tipping paper is adhesively secured to the filter element and the adjacent portion of the smokable rod. The tipping material circumscribes the length of the filter element at about 4 mm of the length of the smokable rod.

Cigarettes prior to providing the cavity for the inner rod so described are manufactured using a Pilot Cigarette Maker from Hauni-Werke Korber & Co. KG. A ring of laser perforations is provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. Each perforated cigarette is about 24 percent air diluted.

When smoked, the cigarette yields visible mainstream aerosol that resembles the mainstream tobacco smoke of traditional cigarettes that burn tobacco cut filler. The mainstream aerosol produced by the cigarette includes tobacco smoke produced by burning tobacco, components resulting from the thermal decomposition of the treated tobacco, and volatilized aerosol forming material. The cigarette generates tobacco smoke sensations, taste and quality that are comparable to that of traditional cigarettes that burn tobacco cut filler. The cigarette does not generate any perceptible amount of the undesirable thermal decomposition products characteristic of the thermal decomposition of glycerin. The smokable rod of the cigarette burns down, in a manner similar to a traditional type of cigarette that burns tobacco cut filler. The smoker can smoke the cigarette until for a desired number of puffs, but the smoker typically extinguishes the cigarette when the firecone of the burning smokable rod approaches the region occupied by the tipping paper. The cigarette produces an ash that is similar in certain regards to other traditional types of cigarettes that burn tobacco cut filler, although the color of the ash is slightly darker than the light gray ash characteristic of those traditional types of cigarettes.

Example 2

A cigarette of the general type described previously with reference to FIG. 1 is provided. The cigarette has a total length of about 84 mm. The cigarette possesses a smokable rod having a length of about 57 mm and a filter element having a length of about 27 mm. When viewed end on, the cigarette has a generally circular cross-sectional shape. The circumference of the smokable rod is about 25 mm.

The inner rod having a generally cylindrical shape is produced by wrapping a filler material within a wrapping material. The wrapping material circumscribes the filler material such that the wrapping material and filler material each extend along the total length of the rod. The wrapping material provides the outer longitudinal surface of the inner rod, and each end is open to expose the filler material within that rod. The rod has a length of about 57 mm and a circumference of about 14 mm.

The wrapping material of the inner rod is a 17 mm wide cigarette paper wrapper of the type described in Example 1.

The filler material of the inner rod is a cast sheet material composed of tobacco and glycerin, and is of the type described previously in Example 1. The filler material has a moisture content of about 12 to about 13 percent. The amount of that material that is positioned in the wrapping material of the inner rod weighs about 180 mg. The packing density of the material within the inner rod is about 130 mg/cm$^3$.

The packing density of the cut filler blend within the outer portion of the smokable rod is about 500 mg/cm$^3$. The filler material that is used to manufacture the outer portion of the smokable rod is composed of virtually all tobacco of some form. The predominant amount of the filler material used to manufacture the outer portion of the smokable rod is treated with a burn suppressing agent (i.e., the exogenous salt); and a portion of the physical blend of that material is composed of a material that consists predominantly of tobacco and aerosol forming material.

The smokable material that is disposed in the region between the outer wrapping material and the inner rod is a blend of various tobaccos. The blend contains about 17 percent burley tobacco lamina, about 34 percent flue-cured tobacco lamina, about 21 percent reconstituted tobacco material manufactured using the paper-type reconstitution process employed by R. J. Reynolds Tobacco Company and known as "G-7," and about 16 percent Oriental tobacco. The blend is composed of virtually all tobacco, and no tobacco substitutes, non-tobacco fillers or non-tobacco extenders are used in the blend or within processed tobaccos of the blend. The blend has about 6 percent of an aqueous casing of sugars, cocoa, licorice, glycerin and flavors applied thereto prior to cutting into filler form. The burley, flue-cured, reconstituted tobacco material and Oriental portion of the blend is treated with potassium citrate. That is a solution of about 50 percent potassium citrate dissolved in about 50 percent water is applied to the tobacco by spraying. The treated tobacco then is dried to a moisture content of about 12 percent to about 13 percent. The amount of potassium citrate within the treated blend is about 10 percent, based on the dry weight of all of the tobacco within the final blend. Then, the final blend is provided by mixing the 94 percent of the tobacco blend treated so as to be in intimate contact with potassium citrate with about 6 percent DIET-type expanded tobacco filler (which is composed of about 65 percent expanded flue-cured shredded lamina and 35 percent expanded burley tobacco shredded lamina). The moisture content of the tobacco cut filler blend of the outer portion of the rod is about 12 percent to about 13 percent. The resulting treated smokable material of the outer section of the smokable rod weighs about 700 mg. The packing density of the smokable material within the outer portion of the smokable rod is about 400 mg/cm$^3$.

The inner rod is positioned within an outer rod. The inner rod is centrally positioned within the outer rod so that the smokable material of the outer rod completely circumscribes the entire length of the inner rod at a radial depth of about 1.5 mm.

The wrapping material of the inner rod is a 27 mm wide cigarette paper wrapper of the type described in Example 1.

The filter element is manufactured using conventional cigarette filter making technology from cellulose acetate tow (2.7 denier per filament, 35,000 total denier) plasticized using triacetin, and circumscribing non-air permeable paper plug wrap. The concentric smokable rod and filter element are aligned in an abutting, end-to-end relationship and secured together using a non-air permeable tipping paper. The tipping paper is adhesively secured to the filter element and the adjacent portion of the smokable rod. The tipping material circumscribes the length of the filter element at about 4 mm of the length of the smokable rod.

Cigarettes so described prior to providing the cavity for the inner rod are manufactured using a Pilot Cigarette Maker from Hauni-Werke Korber & Co. KG. A ring of laser perforations are provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. Each perforated cigarette is about 24 percent air diluted.

When smoked, the cigarette yields visible mainstream aerosol that resembles the mainstream tobacco smoke of traditional cigarettes that burn tobacco cut filler. The mainstream aerosol produced by the cigarette includes tobacco smoke produced by burning tobacco, components resulting from the thermal decomposition of the treated tobacco, and aerosol forming material. The cigarette generates a tobacco smoke sensations, taste and quality that are comparable to that of traditional cigarettes that burn tobacco cut filler. The cigarette does not generate any perceptible amount of the undesirable thermal decomposition products characteristic of the thermal decomposition of glycerin. The smokable rod of the cigarette burns down, in a manner similar to a traditional type of cigarette that burns tobacco cut filler. The smoker can smoke the cigarette until for a desired number of puffs, but the smoker typically extinguishes the cigarette when the firecone of the burning smokable rod approaches the region occupied by the tipping paper. The cigarette produces an ash that is similar to other traditional types of cigarettes that burn tobacco cut filler, although the color of the ash is slightly darker than the light gray ash characteristic of those traditional types of cigarettes.

Example 3

A cigarette of the general type described previously with reference to FIG. 2 is provided. The cigarette has a total length of about 84 mm. The cigarette possesses a smokable rod having a length of about 57 mm and a filter element having a length of about 27 mm. When viewed end on, the cigarette has a generally circular cross-sectional shape. The circumference of the smokable rod is about 25 mm. The cigarette is produced using the same outer blend and cigarette paper outer wrapper described previously in Example 1. However, except the longitudinally extending cavity produced for the tobacco of the inner core is about 50 mm in depth. As such, there is provided a cylindrical segment of filler material extending about 7 mm along the length of that rod. The cylindrical segment of filler material is positioned adjacent to the filter element.

The inner smokable material is a reconstituted tobacco material manufactured using the paper-type reconstitution process employed by R. J. Reynolds Tobacco Company and known as "G-7." The tobacco is in used in cut filler form. No wrapping material is positioned between the inner and outer sections of the smokable rod. The weight of the inner cut filler smoking material is about 180 mg. Care is taken to avoid comingling of the materials of the inner and outer sections. As such, an inner core of smokable material and an outer circumscribing region for that core region is provided.

The material that is disposed inside of the outer wrapping material and forms the annulus encircling the inner rod, as well as the cylindrical segment located at the mouth end of the smokable rod, is a blend of tobaccos in cut filler form. That blend is virtually identical to the blend of smokable material described previously in Example 1 as being the smokable material that is disposed in the region between the outer wrapping material and the inner rod. The amount of that blend used to provide the outer segment that encircles the inner core, and that is used to provide the cylindrical segment, weighs about 890 mg. The packing density of the smokable material within the outer annular portion of the smokable rod is about 500 mg/cm$^3$, and the packing density of the cylindrical segment is about 350 mg/cm$^3$.

The filter element is of the type described in Example 1. The filter element is attached to the rod in the manner described in Example 1.

Cigarettes so described prior to providing the cavity for the inner rod are manufactured using a Pilot Cigarette Maker from Hauni-Werke Korber & Co. KG. A ring of laser perforations are provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. The perforated cigarette is about 24 percent air diluted.

The cigarette is smoked under FTC smoking conditions. The cigarette yields about 12 puffs. The cigarette yields about 16.2 mg wet total particulate matter. The cigarette yields about 12 mg "tar," about 0.5 mg nicotine, and about 17.3 mg carbon monoxide. About 3.7 mg of the wet total particulate matter consists of water. About 33 percent of the "tar" consists of glycerin. Thus, greater than about 45 percent of the wet total particulate matter of that cigarette consists of glycerin and water. Thus, the mainstream aerosol generated by that cigarette possesses a significant amount of components that that are chemically simple.

Example 4

A cigarette of the general type described previously with reference to FIG. 3 is provided. The cigarette has a total length of about 84 mm. The cigarette possesses a smokable rod having a length of about 57 mm and a filter element having a length of about 27 mm. When viewed end on, the cigarette has a generally circular cross-sectional shape. The circumference of the smokable rod is about 25 mm. The smokable rod possesses the same outer wrapping material as is used for manufacturing the smokable rod described in Example 1. However, the cavity produced for the smokable material of the inner core is about 50 mm in depth allowing for a cylindrical segment of tobacco filter of about 7 mm in length to be present adjacent to the filter element.

The filler material of the inner rod is a cast sheet material composed of tobacco and glycerin, and is of the type described previously in Example 1. The filler material has a moisture content of about 12 to about 13 percent. The amount of that material that is positioned in the wrapping material of the inner rod weighs about 180 mg. The packing density of the material within the inner rod is about 130 mg/cm$^3$.

The material that is disposed inside of the outer wrapping material and forms the annulus encircling the inner rod, as well as the cylindrical segment located at the mouth end of the smokable rod, is a blend of tobaccos in cut filler form. That blend is virtually identical to the blend of smokable material described previously in Example 2 as being the smokable material that is disposed in the region between the outer wrapping material and the inner rod. The amount of that blend used to provide the outer segment that encircles the inner core, and that is used to provide the cylindrical segment, weighs about 890 mg. The packing density of the smokable material within the outer annular portion of the smokable rod is about 500 mg/cm$^3$, and the packing density of the cylindrical segment is about 350 mg/cm$^3$.

The filter element is of the type described in Example 1. The filter element is attached to the rod in the manner described in Example 1.

Cigarettes so described prior to providing the cavity for the inner rod are manufactured using a Pilot Cigarette Maker from Hauni-Werke Korber & Co. KG. A ring of laser perforations is provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. The perforated cigarette is about 24 percent air diluted.

The cigarette is smoked under FTC smoking conditions. The cigarette yields about 11.6 puffs. The cigarette yields about 15.8 mg wet total particulate matter. The cigarette yields about 12.3 mg "tar," about 0.62 mg nicotine, and about 15.7 mg carbon monoxide. About 2.9 mg of the wet total particulate matter consists of water. About 34 percent of the "tar" consists of glycerin. Thus, greater than about 40 percent of the wet total particulate matter of that cigarette consists of glycerin and water. Thus, the mainstream aerosol generated by that cigarette Example 5

A cigarette of the general type described previously with reference to FIG. 3 is provided. The cigarette has a total length of about 84 mm. The cigarette possesses a smokable rod having a length of about 57 mm and a filter element having a length of about 27 mm. When viewed end on, the cigarette has a generally circular cross-sectional shape. The circumference of the smokable rod is about 25 mm. The smokable rod possesses the same outer wrapping material as is used for manufacturing the smokable rod described in Example 1. However, the cavity produced for the smokable material of the inner core is about 50 mm in depth allowing for a cylindrical segment of tobacco filter of about 7 mm in length to be present adjacent to the filter element.

The smokable material of the inner rod is a cast sheet material composed of tobacco and glycerin, and is of the type described previously in Example 1. However, that material is not provided in cut filler form. A rectangular sheet of the material, weighing about 160 mg, and having dimensions of about 25 mm by about 50 mm, is rolled to produce a cylinder having a length of about 50 mm and a diameter of about 14 mm. The sheet is rolled so that when the cylinder is viewed end-on, the configuration of the rolled sheet resembles a spiral. The filler material has a moisture content of about 12 to about 13 percent.

The material that is disposed inside of the outer wrapping material and forms the annulus encircling the inner rod, as well as the cylindrical segment located at the mouth end of the smokable rod, is a blend of tobaccos in cut filler form. That blend is virtually identical to the blend of smokable material described previously in Example 2 as being the smokable material that is disposed in the region between the outer wrapping material and the inner rod. The amount of that blend used to provide the outer segment that encircles the inner core, and that is used to provide the cylindrical segment, weighs about 890 mg. The packing density of the smokable material within the outer annular portion of the smokable rod is about 500 mg/cm$^3$, and the packing density of the cylindrical segment is about 350 mg/cm$^3$.

The filter element is of the type described in Example 1. The filter element is attached to the rod in the manner described in Example 1.

Cigarettes so described prior to providing the cavity for the inner rod are manufactured using a Pilot Cigarette Maker from Hauni-Werke Korber & Co. KG. A ring of laser perforations is provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. The perforated cigarette is about 24 percent air diluted.

Example 6

A cigarette of the general type described previously with reference to FIG. 4 is provided. The cigarette has a total length of about 84 mm. The cigarette possesses a smokable rod having a length of about 57 mm and a filter element having a length of about 27 mm. When viewed end on, the cigarette has a generally circular cross-sectional shape. The circumference of the smokable rod is about 25 mm. The smokable rod possesses a single smokable blend, and that blend is employed to provide one blended filler component of essentially consistent composition over the entire region within the outer wrapping material. The outer wrapping material is of the type described previously in Example 1. The single smokable blend is virtually identical to that blend of the outer sheath of the co-axial smokable rod described previously in Example 1. The blended smokable material is packed within the rod at a packing density of about 290 mg/cm$^3$.

The filter element is virtually identical to the type of filter element described in Example 1; and the filter element is attached to the smokable rod using tipping material, in the manner described in Example 1. As such, the tipping material circumscribes the length of the filter element at about 4 mm of the length of the smokable rod.

Cigarettes so described are manufactured using a Pilot Cigarette Maker from Hauni-Werke Korber & Co. KG. A ring of laser perforations is provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. The perforated cigarette is about 22 percent air diluted.

The cigarette is smoked under FTC smoking conditions. The cigarette yields about 10.4 puffs, and about 15.4 mg wet total particulate matter. The cigarette yields about 11.2 mg "tar," about 0.45 mg nicotine, and about 12 mg carbon monoxide. About 3.7 mg of the wet total particulate matter consists of water. About 43.7 percent of the "tar" consists of glycerin. Thus, greater than about 50 percent of the wet total particulate matter of that cigarette consists of glycerin and water. Thus, the mainstream aerosol generated by that cigarette possesses a significant amount of components that that are chemically simple.

When smoked, the cigarette yields visible mainstream aerosol that resembles the mainstream tobacco smoke of traditional cigarettes that burn tobacco cut filler. The mainstream aerosol produced by the cigarette includes tobacco smoke produced by burning tobacco, components resulting from the thermal decomposition of the treated tobacco, and aerosol forming material. The cigarette generates tobacco smoke sensations, taste and quality that are comparable to that of traditional cigarettes that burn tobacco cut filler. The cigarette produces a mainstream smoke that can be characterized as being smooth, not being harsh and exhibiting pleasant mouthfeel. The cigarette does not generate any perceptible amount of the undesirable thermal decomposition products characteristic of the thermal decomposition of glycerin. The smokable rod of the cigarette is consumed, in a manner similar to the manner that a traditional type of cigarette that burns tobacco cut filler. The smoker can smoke the cigarette until for a desired number of puffs, but the smoker typically extinguishes the cigarette when the firecone of the burning smokable rod approaches the region occupied by the tipping paper. The cigarette produces an ash that in certain regards resembles the ash of other traditional types of cigarettes that burn tobacco cut filler, although the color of the ash is slightly darker than the light gray ash characteristic of those traditional types of cigarettes.

What is claimed is:

1. A smokable rod for a cigarette comprising:

(a) a lighting end and a mouth end;

(b) a longitudinally extending outer portion circumscribing a core portion in an annular manner, the outer portion being composed predominantly of tobacco in cut filler form, the outer portion being substantially free of aerosol forming material;

(c) a longitudinally extending core portion incorporating a smokable material, the core portion (i) being physically separate from the outer portion, (ii) incorporating tobacco material in intimate contact with a burn suppressing agent, the burn suppressing agent being present in an amount and of a type such that the core does not undergo burning, and (iii) being composed predominantly of tobacco material and aerosol forming material;

(d) the outer portion being physically separate from the core portion; and (e) an outer wrapping material circumscribing the outer portion.

2. The rod of claim 1 further comprising a wrapping material for the core portion, said wrapping material physically separating the core portion from the outer portion.

3. The rod of claim 1 having a mouth end piece attached to the mouth end thereof

4. The rod of claim 1 having a cylindrical shape, the rod having a longitudinally extending outer surface, the outer wrapping material providing the longitudinally extending outer surface, and the lighting end and mouth end each being open to expose the core and outer portions.

5. The rod of claim 1 further comprising a wrapping material for the core portion, said wrapping material physically separating the core portion from the outer portion longitudinally along the rod, the lighting end and mouth end each being open to expose the core and outer portions.

6. The rod of claim 4 having a mouth end piece attached to the mouth end thereof

7. The rod of claim 1 wherein the aerosol forming material includes glycerin.

8. The rod of claim 1 wherein the outer wrapping material is composed of paper.

9. The rod of claim 2 wherein the wrapping material for the core portion is composed of paper.

10. The rod of claim 1 wherein the outer wrapping material exhibits an inherent porosity of at least about 15 CORESTA units.

11. The rod of claim 2 wherein the wrapping material for the core portion exhibits an inherent porosity of more than about 100 CORESTA units.

12. The rod of claim 1 wherein essentially all of the tobacco material of the core portion is composed of tobacco in cut filler form.

13. The rod of claim 1 wherein essentially all of the tobacco material of the core portion is composed of tobacco laminae, processed tobacco, or a blend thereof.

14. The rod of claim 13 wherein at least a portion of the tobacco material of the core portion is cased and/or top dressed.

15. The rod of claim 13 wherein the processed tobacco is composed of essentially all tobacco.

16. The rod of claim 1 wherein the tobacco material of the core portion is composed of essentially all tobacco.

17. The rod of claim 1 wherein the tobacco material of the core portion is in intimate contact with at least one salt exogenous to that tobacco material.

18. The rod of claim 17 wherein the exogenous salt includes an alkali metal salt of a carboxylic acid.

19. The rod of claim 1 wherein more than 60 percent by weight of core portion is composed of tobacco material and aerosol forming material.

20. The rod of claim 1 wherein, upon use, the outer portion is burned from the lighting end toward the mouth end, and a majority of the outer portion undergoes smolder.

21. The rod of claim 1 wherein the core portion incorporates processed tobacco, and the processed tobacco is absent of exogenous inorganic filler material.

22. The rod of claim 1 wherein the core portion incorporates processed tobacco, the processed tobacco being absent of exogenous inorganic filler material, and the processed tobacco being composed of more than 90 percent by weight of tobacco, aerosol forming material, exogenous salt and binder.

23. The rod of claim 22 wherein the aerosol forming material includes glycerin and the binder includes an alginate or guar gum.

* * * * *